US008540181B2

(12) United States Patent
Fischer et al.

(10) Patent No.: US 8,540,181 B2
(45) Date of Patent: Sep. 24, 2013

(54) FOIL ROLL WITH WOUND STIFFENING CORE, APPARATUS FOR WINDING THE ROLL AND METHOD

(75) Inventors: Larry D. Fischer, Freeland, MD (US); Robert E. Molison, Hanover, PA (US); Eric S. Willet, New Oxford, PA (US)

(73) Assignee: Elsner Engineering Works, Inc., Hanover, PA (US)

( * ) Notice: Subject to any disclaimer, the term of this patent is extended or adjusted under 35 U.S.C. 154(b) by 355 days.

(21) Appl. No.: 12/821,484

(22) Filed: Jun. 23, 2010

(65) Prior Publication Data

US 2010/0327100 A1 Dec. 30, 2010

Related U.S. Application Data

(60) Provisional application No. 61/219,846, filed on Jun. 24, 2009.

(51) Int. Cl.
*B65H 18/14* (2006.01)

(52) U.S. Cl.
USPC ..... 242/532.1; 242/532.2; 242/535.1

(58) Field of Classification Search
USPC ..... 242/532, 532.1–532.2, 527.2, 535.1
See application file for complete search history.

(56) References Cited

U.S. PATENT DOCUMENTS

| | | | | |
|---|---|---|---|---|
| 934,744 | A | 9/1909 | Mitchem | |
| 3,390,762 | A | 7/1968 | Mernieks | |
| 5,105,944 | A | 4/1992 | Ingalls et al. | |
| 5,344,091 | A | 9/1994 | Molison | |
| 7,043,888 | B2 | 5/2006 | Gerulski et al. | |
| 7,887,003 | B2 * | 2/2011 | Maddaleni et al. | 242/532.3 |
| 7,992,818 | B2 * | 8/2011 | Maddaleni et al. | 242/528 |
| 2002/0190152 | A1 | 12/2002 | Haraikawa et al. | |

FOREIGN PATENT DOCUMENTS

| | | | |
|---|---|---|---|
| EP | 1256541 | A2 | 11/2002 |
| JP | 57098450 | | 6/1982 |
| JP | 03081016 | | 4/1991 |
| JP | 09295726 | A * | 11/1997 |
| JP | 09315690 | | 12/1997 |
| JP | 2002265102 | | 9/2002 |

* cited by examiner

*Primary Examiner* — Sang Kim
(74) *Attorney, Agent, or Firm* — Andrew D. Mead

(57) ABSTRACT

A foil roll having a wound stiffener core formed from an initially flat sheet of stiffener material fed into a spiral roll winder simultaneously with a feed end of a foil web. An apparatus and method for spirally winding a foil roll with a wound stiffener core in which a stiffener sheet is fed into a roll winder in adjacent outward contact with a foil web and a leading edge of the stiffener slightly ahead of a feed end of a foil web. The stiffener sheet is outwardly disposed from the foil web and in adjacent contact with the roll starter guides to prevent contact between guides and the foil web during initial core formation. Roll starter guides are moved from contact with the outer periphery of the roll once the initial core is formed allowing a desired length of foil web to be spirally wound around the core without damage to the web. The apparatus is configured to receive a continuous supply of foil and stiffener web material, cut each to predetermined lengths, and sequentially form wound core foil rolls at an economically high rate.

39 Claims, 23 Drawing Sheets

STARTING OF ALUMINUM FOIL ROLL W/ INTERWOUND SHEET STIFFENER

STARTING OF ALUMINUM FOIL ROLL W/ INTERWOUND SHEET STIFFENER
ALTERNATE EMBODIMENT

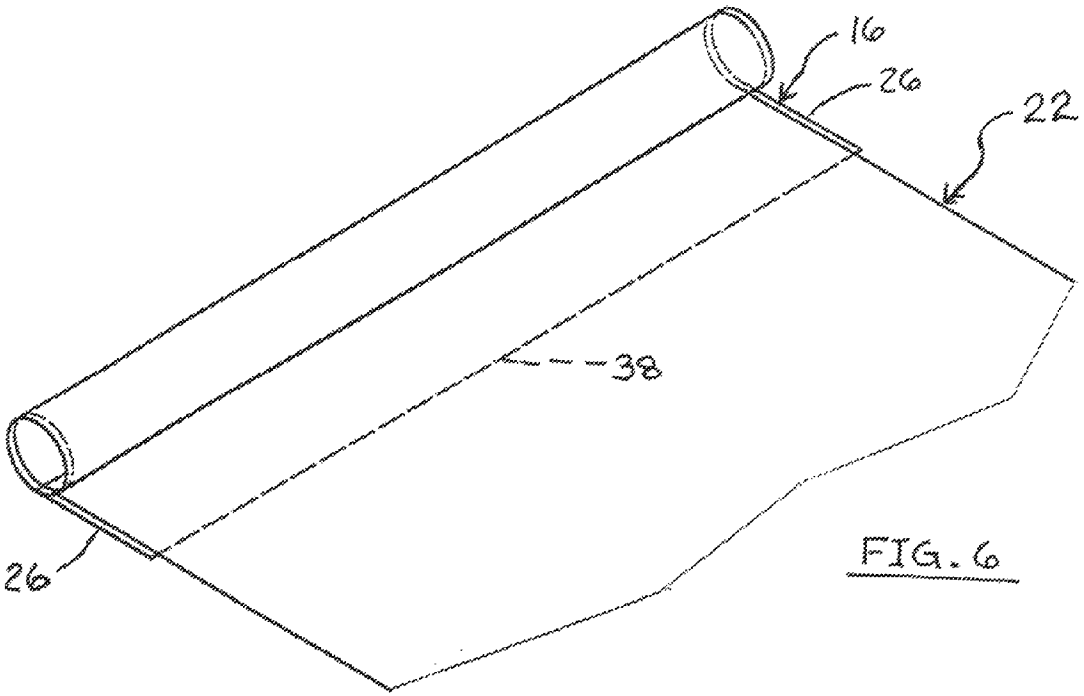
FIG. 6
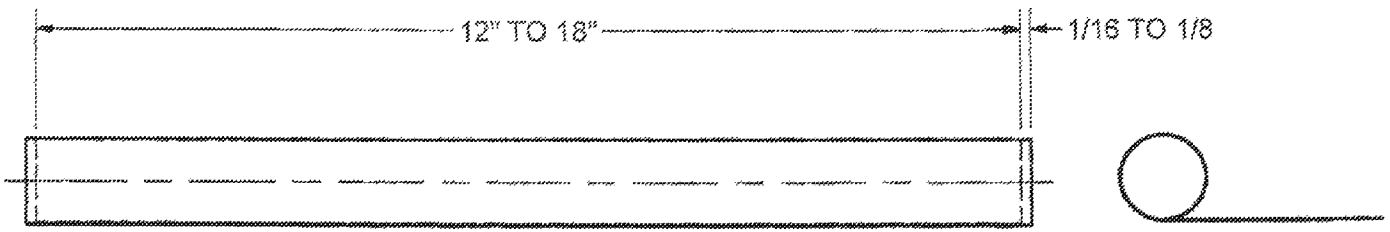
FIG. 8
ALUMINUM FOIL ROLL W/PROTRUDING INTERWOUND SHEET STIFFENER CORE
FIG. 7

ALUMMINUM FOIL ROLL W/ INTERWOUND SHEET STIFFENER CORE HAVING THE SAME WIDTH

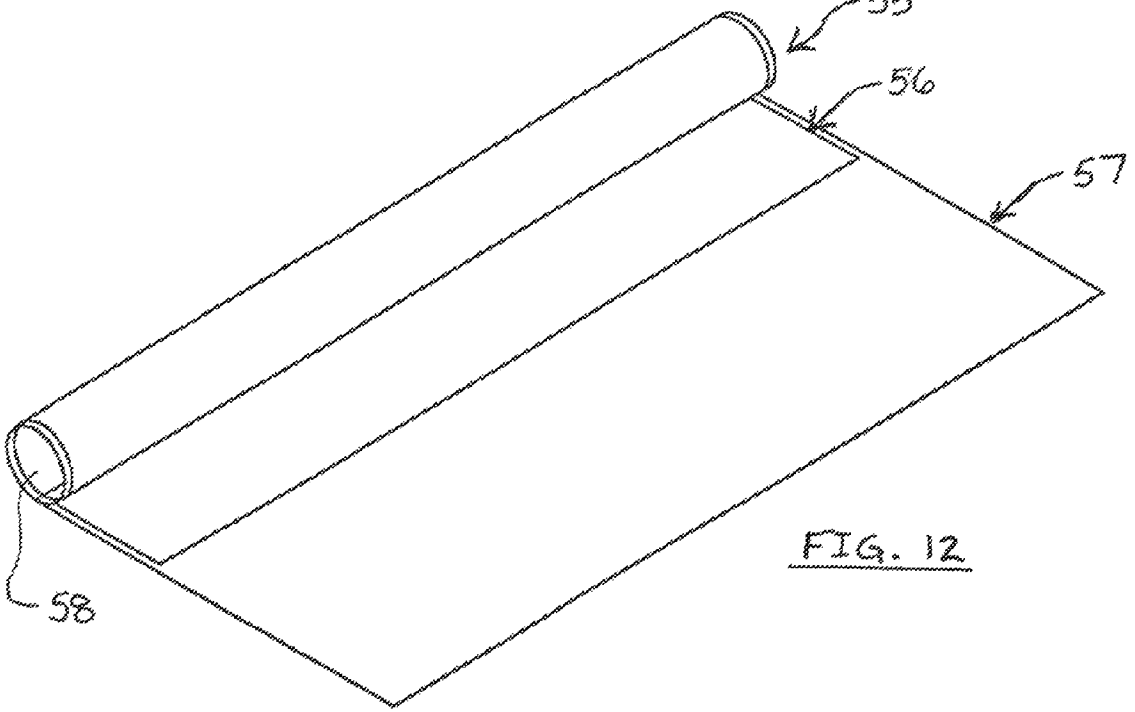
FIG. 12
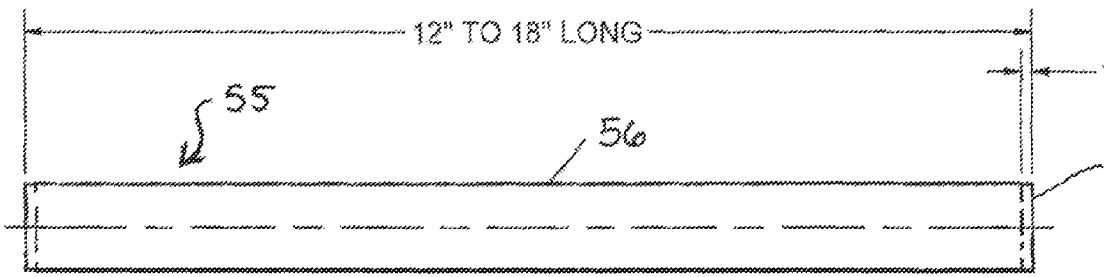
FIG. 13 ALUMINUM FOIL ROLL W/ INTERWOUND INTRUDING SHEET STIFFENER CORE
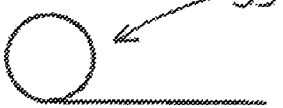
FIG. 14

SECTION H-H

SECTION I-I

SECTION R-R

SECTION K-K

SECTION U-U

SECTION V-V

SECTION M-M

SECTION L-L

FOIL ROLL WITH WOUND STIFFENING CORE, APPARATUS FOR WINDING THE ROLL AND METHOD

CROSS-REFERENCE TO RELATED APPLICATIONS

This application claims the benefit of priority of U.S. Provisional Application 61/219,846, filed Jun. 24, 2009.

BACKGROUND OF THE INVENTION

The invention relates generally to machines and methods for wrapping aluminum foil around a stiffly flexible material, and more specifically to a machine and method for simultaneously winding aluminum foil and a stiffening material to form a core around which aluminum foil may be wrapped.

Rolls of thin aluminum foil sold for domestic and commercial use are manufactured by winding aluminum foil web on preformed cylindrical cardboard cores. Roll winding machine rotate the cardboard cores to pull aluminum foil web from a larger supply until a desired quantity of foil is wound around the cardboard core. The cardboard cores are expensive to make, expensive to transport from the core manufacturer to the foil winding site and expensive to store at the foil winding site prior to winding of foil rolls.

It would be advantageous to provide a foil roll having a wound stiffener core that replaces known wound foil rolls having pre-formed cylindrical cardboard stiffener cores overcoming the above disadvantages. Further advantages would be realized by a machine and method enabling a web material for a stiffening core to be coextensively introduced with a leading end of the foil web and simultaneously formed into a spiral wound core around which a desired quantity of foil web can subsequently be wound. Still further advantages would be realized in a machine and method capable of simultaneously winding a sheet of stiffener material and a leading portion of a foil web without damage or deformation of the leading portion of the foil web.

SUMMARY OF THE INVENTION

The term "core" as subsequently used herein means a wound stiffener core formed in accordance with the present invention unless otherwise specified.

Accordingly, the present invention, in any of the embodiments described herein, may provide one or more of the following advantages:

The invention is an improved aluminum foil roll with a sheet core which is wound during winding of the roll and an apparatus and method for forming aluminum foil roll in which the roll core is wound from a flat core sheet simultaneously with winding the aluminum foil on the wound core. The aluminum foil is wound onto the core at high speed without creasing or deforming the highly malleable material. Creases and deformations in the foil are retained in the non-elastic foil and are unacceptable.

During winding of the roll, the lead end of the foil is preferably fed into the nip between the initial windings of the core sheet and the unwound remainder of the core sheet. Winding of the remainder of the core sheet in the coil captures the lead end of the foil in the core between windings of the sheet and frictionally holds the foil in the wound core without creasing or deforming the foil. The lead end of the foil may be fed into the winding mechanism prior to formation of the nip in the core sheet as long as the lead end of the foil lags the leading edge of the core sheet so that only the core sheet comes into contact with guide structures in the winding mechanism. Continued rotation of the core winds the remainder of the foil into the core without deformation.

The improved aluminum foil roll, with wound core, reduces the cost of the aluminum foil rolls by eliminating preformed cylindrical cardboard cores. Shipping of the core material, in the form of a wound roll of core sheet material, which may be Kraft paper, is reduced over the cost of shipping preformed cylindrical cores. Storage cost is reduced. There is no need to pre-manufacture a core or to store pre-manufactured cores prior to winding of foil rolls.

The apparatus for forming a wound core foil roll should also be durable in construction, simple and effective to use, and capable of producing wound core foil rolls at an economically high rate.

These and other objects are achieved by a foil roll having a wound stiffener core formed from an initially flat sheet of stiffener material fed into a spiral roll winder simultaneously with a feed end of a foil web. An apparatus and method for spirally winding a foil roll with a wound stiffener core in which a stiffener sheet is fed into a roll winder in adjacent outward contact with a foil web and a leading edge of the stiffener slightly ahead of a feed end of a foil web. The stiffener sheet is outwardly disposed from the foil web and in adjacent contact with the roll starter guides to prevent contact between guides and the foil web during initial core formation. Roll starter guides are moved from contact with the outer periphery of the roll once the initial core is formed allowing a desired length of foil web to be spirally wound around the core without damage to the web. The apparatus is configured to receive a continuous supply of foil and stiffener web material, cut each to predetermined lengths, and sequentially form wound core foil rolls at an economically high rate.

BRIEF DESCRIPTION OF THE DRAWINGS

The advantages of this invention will be apparent upon consideration of the following detailed disclosure of the invention, especially when taken in conjunction with the accompanying drawings wherein:

FIG. 6 is a perspective view illustrating a winding of the roll shown in FIG. 4 or 5, during winding;

FIGS. 7 and 8 are side and end views of the roll shown in FIG. 6;

FIGS. 12, 13 and 14 are views like FIGS. 6, 7 and 8 showing a different roll where the width of the core is less than the width of the aluminum foil web and body;

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "upstream" or "downstream" are used as a matter of mere convenience, and are in reference to the normal feed path of foil web through the machine. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail.

Figure 1:
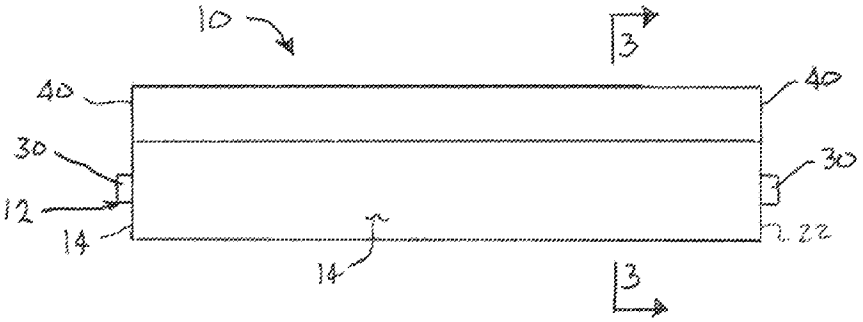
FIG. 1 is a side view of a roll of aluminum foil wound around a wound paper stiffener core according to the invention.
Figure 3:
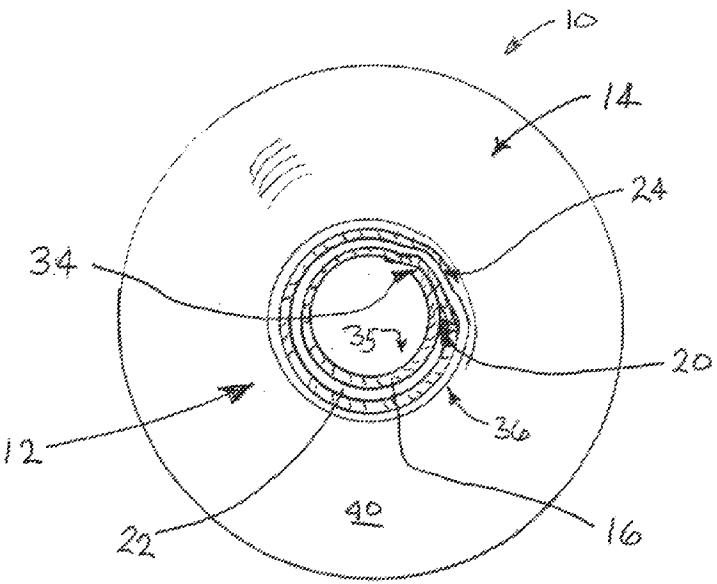
FIG. 3 is an enlarged sectional view taken along line 3-3 of FIG. 1.
Figure 2:
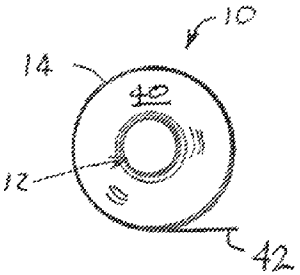
FIG. 2 is an end view of the roll of FIG. 1.

First referring to FIGS. 1 through 3, wound aluminum foil roll 10 includes a spirally wound central core 12 and an aluminum foil body 14 spirally wound around core 12. The core 12 is wound from a segment of a flat stiffening core sheet 16 which may be Kraft paper. Sheet 16 is cut from a length of stiffener paper web. The aluminum foil body 14 is wound from a length of aluminum foil.

Figure 4:
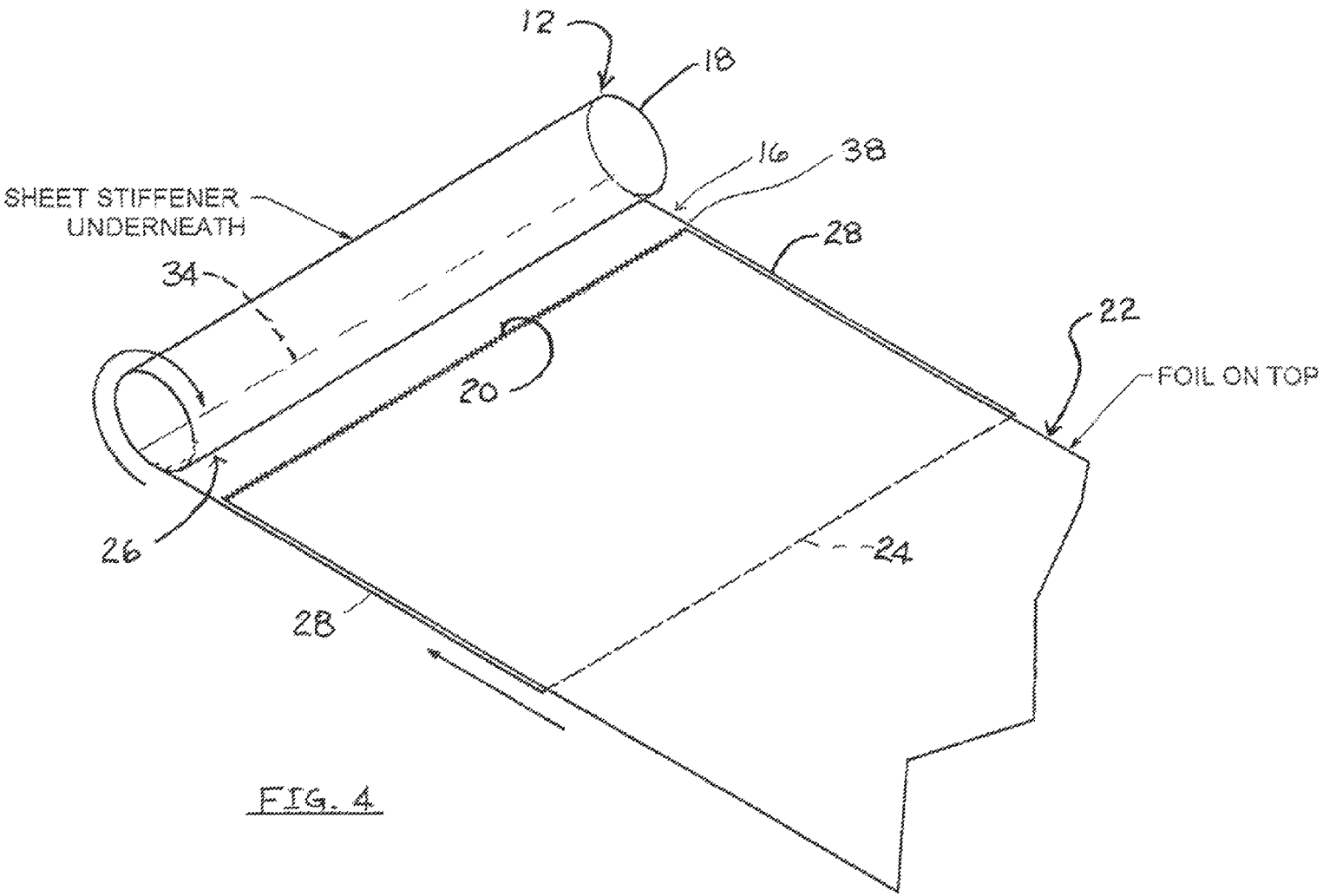
FIG. 4 is a perspective view illustrating a winding of a first embodiment of the roll shown in FIGS. 1-3.
Figure 5:
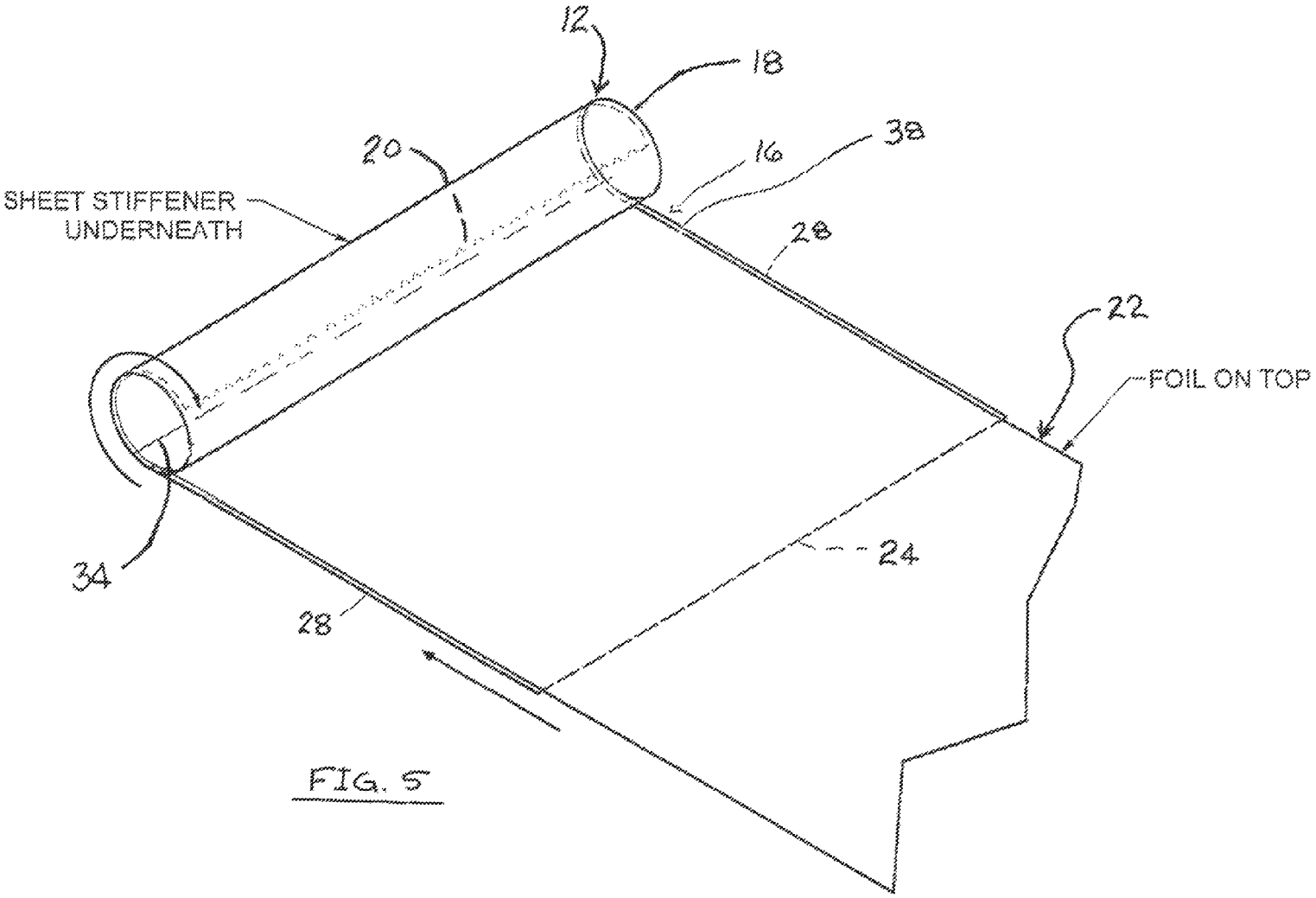
FIG. 5 is a perspective view of a second embodiment of the roll shown in FIGS. 1-3.

As illustrated in FIGS. 3 and 4, core 12 is formed by spirally winding the lead end of flat sheet 16 into an initial spiral winding 18. The inner spiral winding 18 may have a number of 360° wraps of sheet 16. The number of wraps of sheet 16 determined by balancing material cost and desired roll stiffness.

After initiating a winding 18, the lead or feed end 20 of aluminum foil sheet 22 is positioned over the trailing end 24 of sheet 16 on the side of the sheet facing winding 18. While it is preferable to feed the lead end 20 of the foil sheet into the nip formed by the sheet 16 having completed at least one turn to create winding 18 (as shown in FIG. 4), the feed end 20 of the foil sheet may be introduced into the winding prior to completion of the first turn of sheet 16, that is, prior to a complete winding 18 as long as the lead end 20 of the foil sheet 22 trails the leading edge 34 of the sheet 16 by a slight distance so that the feed end 20 of foil sheet does not contact the winding mechanism while the sheet 16 is being fed. This trailing distance may be as little as ¼ to ½ inch. The trailing end 24 of sheet 16 and the lead portion of foil sheet 22 are coextensively moved toward and around the rotating winding 18 at the same speed so that the lead end 20 of the foil is either captured in the nip 26 at the junction between the flat portion of sheet 16 and winding 18 or biased forward by friction between sheet 16 and the foil. Continued rotation of roll core 12 pulls the foil sheet into the core and coextensively winds the lead end 20 of the aluminum foil sheet into the core between adjacent wraps of the stiffening sheet.

During winding of the lead end of the foil sheet into the core, the aluminum foil sheet is not exposed on the exterior surface of the roll and does not contact parts of the winding machine which rotate the core. In this way, the lead end of the aluminum foil sheet is protected from deformation by core sheet 16 as it is wound into the core.

After winding of the lead end of the foil sheet into the core and completion of coextensive winding of the stiffener sheet 16 into the core, the lead end of the foil is frictionally captured in the core and continued rotation of the core pulls the foil sheet toward the core and winds the foil sheet around the core without deformation of the delicate aluminum foil. The foil is tightly wound on the core, without deformation to form spiral aluminum foil body 14 with flat "book end" edges lying in planes perpendicular to the longitudinal axis of the roll.

As illustrated in FIGS. 4-7, the width of core sheet 16 is greater than the width of foil sheet 22. The foil sheet is centered on the core sheet so that core sheet edges 28 extend laterally beyond the edges of the foil sheet. When wound into roll 18, edges 28 form cylindrical collars 30 projecting outwardly from the edge 22 of the wound aluminum foil body 14.

As illustrated in FIG. 3, the core 12 includes an inner portion 34 comprising a number of spiral windings of core sheet 16 overlying each other. These windings extend from the leading edge 34 of the core sheet to sheet trailing edge 24 underlying the feed end 20 of the foil. Continued rotation of the core sheet into the core 12 winds the feed end of the aluminum foil into the core between the overlapping and underlapping spiral windings of the trailing edge 24 of the core sheet to form spirally interwound core outer portion 36 surrounding inner core portion 35. Outer portion 36 ends when the core sheet trailing end 24 is wound into the roll. Continued rotation of the completed core winds the aluminum foil sheet onto the core to form spirally wound aluminum foil body 14 with "book end" end walls 40.

The core sheet 16 is formed from flexible material which, when wound, has sufficient strength to protect the foil during winding of the core, and to support the large and relatively heavy roll of aluminum foil tightly wound on the core. The sheet has a sufficiently high coefficient of friction to hold the lead end of the foil in the core during winding of the foil body 14.

The collars 30 extend to either end of the aluminum foil body 14 protect the aluminum foil from deformation when the roll is placed in a storage box. The collars space the ends of the aluminum roll from the ends of the box. In aluminum foil roll 10, collar 30 may extend out from the ends of the wound foil a distance of 1/16 to ⅛ inches. The outer diameter of the collars may be 1 to 1½ inches. The coil sheet 16 may have a length of about 18 inches with the lead end of the foil sheet positioned at the center of the core sheet so that approximate equal lengths of core sheet are wound into the inner and outer core portions 34 and 36. The sheet 16 may be shorter to reduce cost or longer to provide improved support for aluminum foil body 14.

Roll 10 may have an outside diameter of 2 inches. The core may have a diameter of 1 inch to 1½ inches.

Figure 9:
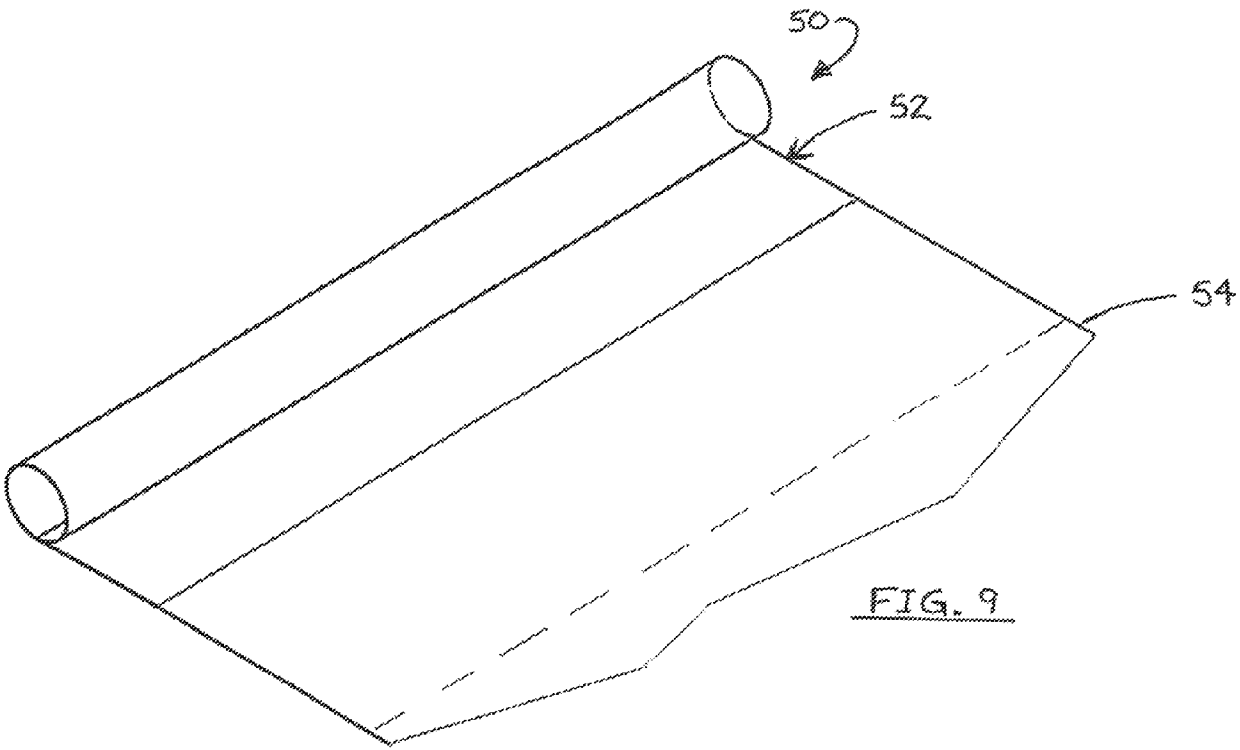
FIGS. 9, 10 and 11 are views similar to FIGS. 6, 7 and 8 showing a different roll where the core does not extend outwardly from the aluminum foil body.
Figure 10:
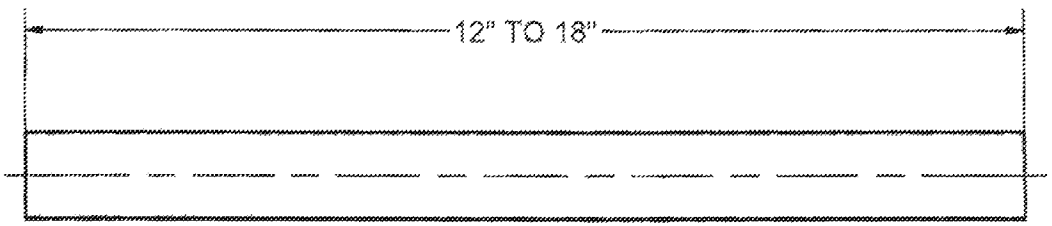
Figure 11:
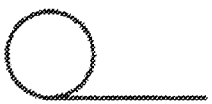

FIGS. 9, 10 and 11 illustrate rolling a second wound aluminum foil roll 50, like roll 10, but with the exception that the core sheet 52 and aluminum foil sheet 54 have the same width so that the stiffening core does not extend outwardly beyond the wound aluminum sheet and the roll does not have collars like collars 30 in roll 10.

FIGS. 12, 13 and 14 illustrate rolling a third aluminum foil roll 55, like roll 10, but with the exception that the core sheet 56 has a width less than the width of the aluminum foil sheet 57 so that the edges of the foil sheet 57 extend outwardly beyond the wound core 58. Roll 55 does not have collars like collars 30 in roll 10.

Figure 15:
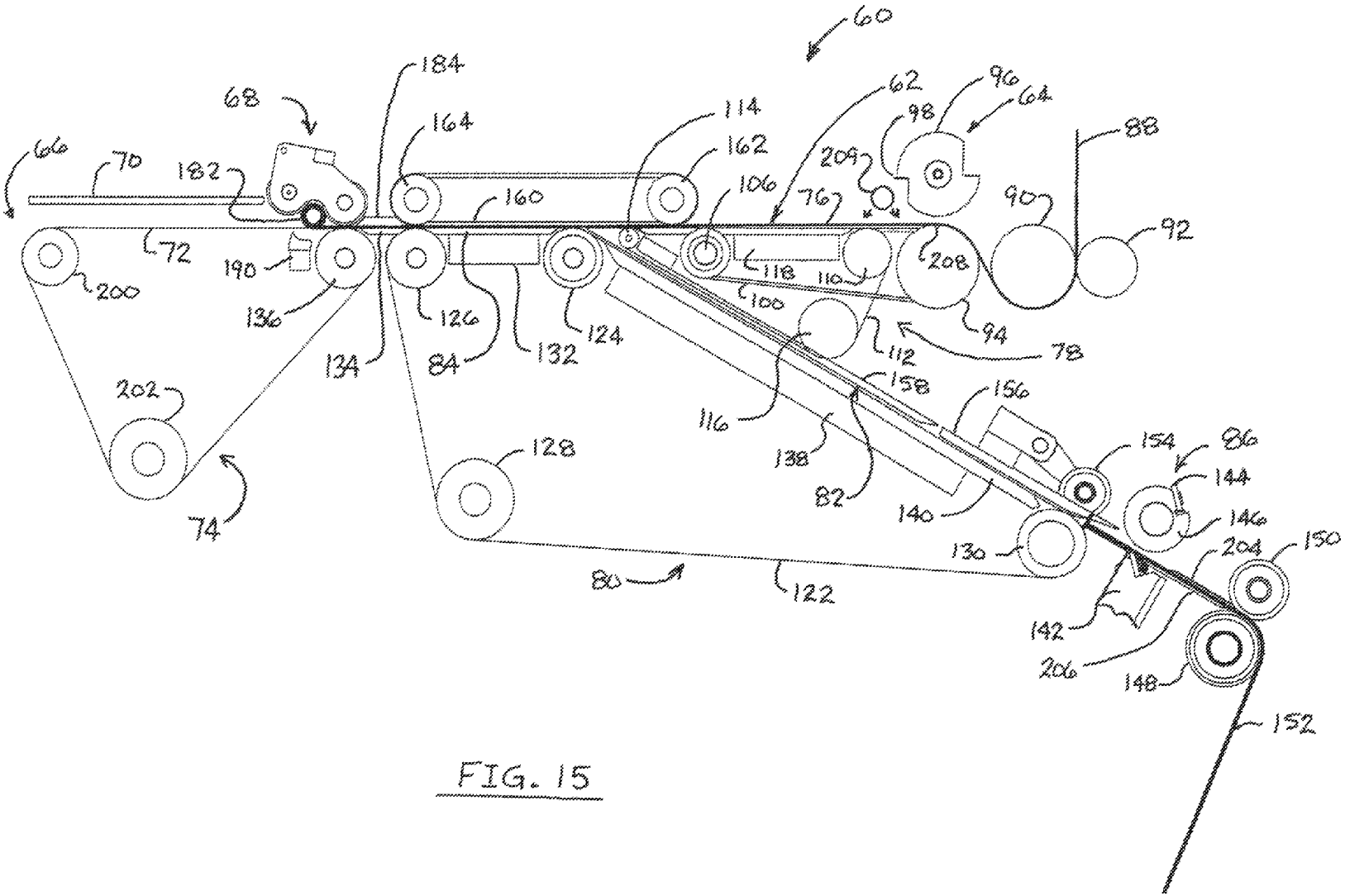
FIGS. 15-19 are side views of a machine for winding rolls of aluminum foil around wound cylindrical cores illustrating the steps of winding a roll.

FIG. 15 illustrates winding machine 60 for forming a wound aluminum foil roll 10 or 50. The winding machine 60 includes a straight, horizontal sheet feed path 62 extending from foil cut off station 64 to roll discharge location 66. Rolling head 68 is located on path 62 and is spaced from location 66 by roll friction rotation bars 70 (only one illustrated). The upper runs of belts 72 of roll discharge conveyor 74 extend from the rolling head 68 to discharge location 66.

The upper run 76 of foil feed conveyor 78 extends along the feed path from foil cut off station 64 toward winder 68. Sheet stiffener and foil feed conveyor 80 includes an upwardly angled sheet stiffener feed run 82 which intersects feed path 62 at an acute angle downstream from the downstream end of upper run 76 of foil feed conveyor 78. Conveyor 80 also includes a stiffener sheet and foil feed run 84 on feed path 62 extending downstream from run 82 toward the winder 68. Stiffener cut off station 86 is located at the lower end of stiffener sheet feed run 82 away from feed path 62.

During operation of machine 60, aluminum foil 88 is fed continuously toward winder 68 at one or more pre-determined foil feed rates. Foil 88 extends from a foil roll between driven foil roll 90 and pinch roller 92 and around anvil roll 94 at cut off station 64. Station 64 includes a cutter roll 96 with a cutting blade 98 and a drive for continuously rotating the roll. A drive is actuated to move cutter roll 96 toward roll 94 at an appropriate time to sever the foil 88 at the top of roll 94.

Figure 30:
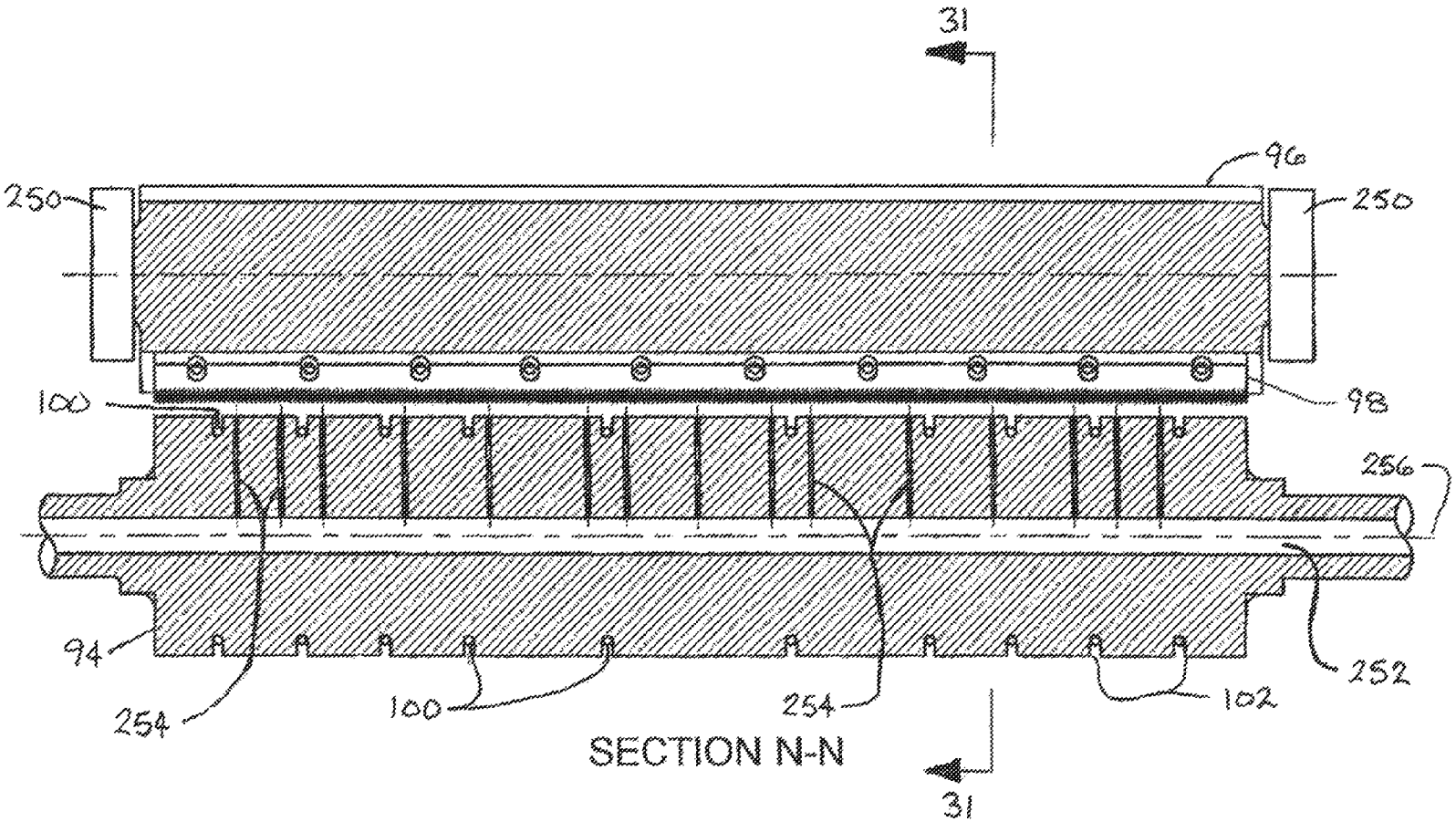
FIG. 30 is a sectional view taken along line N-N of FIG. 20.
Figure 31:
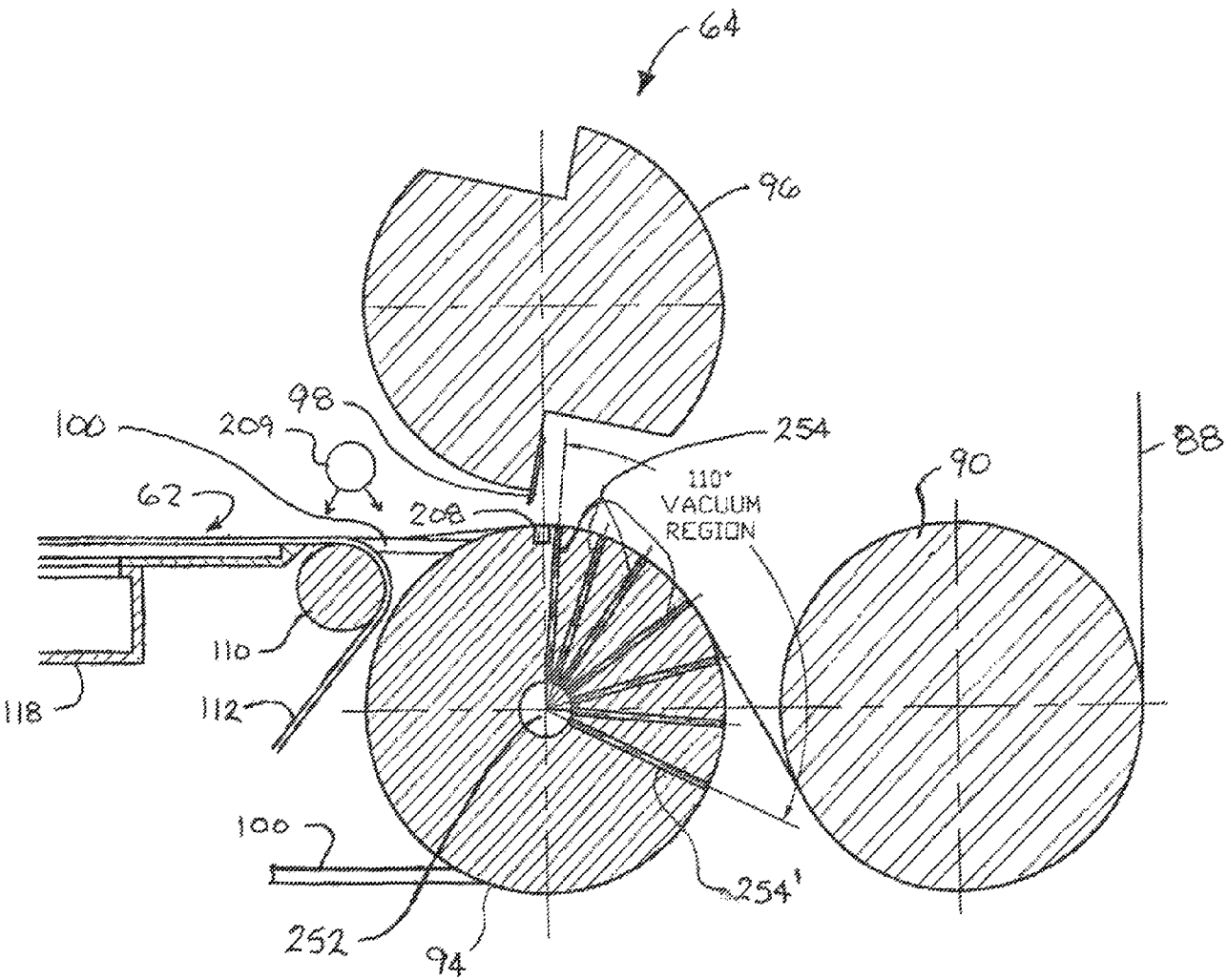
FIG. 31 is a sectional view taken along line 31-31 of FIG. 30.

Foil cut off station 64 is further illustrated in FIGS. 30 and 31. Cutter roll 96 is mounted on the ends of pivot arms 250 for movement toward and away from anvil roll 94 in order to position blade 98 to cut foil 88. The anvil roll 94 includes an axial vacuum passage 252 which is connected to a vacuum source. Sets of seven small diameter radial vacuum passages 254 extend from passage 252 to the outer surface of roll 94 at spaced locations along the length of the roll as illustrated in FIG. 30. FIG. 31 illustrates a set of vacuum passages 254 located in a plane perpendicular to the axis 256 of roll 94 and spaced around the circumference of the roll for 110 degrees upstream from cut slot 208. The sets of passages are close together at the foil edges to assure transfer to path 62.

The reduced pressure in passages 254 vacuum holds the web 88 to the roll 94 upstream from the cut slot 208 so that after cutting of the web, the newly formed upstream end is held on the roll during rotation of the roll and feeding of the lead end of the web onto foil transfer belts 100. The belts strip the lead end of the web from the roll and assist in moving the lead end of the web downstream along path 62 for capture by vacuum belts 112. The roll 94 pushes the foil end downstream. The 110 degree spacing of passages 254 around roll 94 assures that the foil is held on the roll and the lead end is fed onto belts 100 and belts 112 before vacuum holding of the web on the roll 94 is broken as the furthest upstream passage 254' is rotated out of contact with the web. The slightly negative pressure at the circumferential ends of passages 254 is sufficient to hold the foil web on the roll and feed the lead end downstream along path 62 without deforming the foil, typically a few inches of water column. The passages 254 may be 3/16 inches in diameter.

Foil feed conveyor 78 includes two sets of feed belts. See FIGS. 15 and 27-30. Round foil transfer belts 100 are fitted in grooves 102 in roll 94 and grooves 104 in roll 106. The upper runs of belts 100 extend through grooves 108 in roll 110.

Flat apertured vacuum belts 112 extend around roll 110 and downstream along path 62 past roll 106 around small diameter roll 114 and around drive roll 116. A vacuum chamber 118 is located below the run of apertured belts 112 along path 62. The vacuum chamber 118 is connected to a vacuum source through a dump valve so that vacuum can be applied to the box to hold the lead end of a foil sheet against belts 112 during movement down path 62. Vacuum is dumped from chamber 118 after the lead end of the foil sheet has been wound into a roll core at winder 68. Foil feed conveyor 78 includes a number of spaced transfer fingers 120 spaced across path 62 between belts 100 and 112 and extending downstream past roll 114. Fingers 120 guide the lead end of a foil strip from belts 112 to the apertured vacuum belts 122 of conveyor 80, as described below.

Sheet stiffener and foil feed conveyor 80 includes a series of transversely spaced apertured flat vacuum belts 122 which extend around rolls 124 and 126 on path 62, roll 128 located below roll 126 and roll 130 located at the upstream end of run 82. A drive motor (not illustrated) moves belts 122 downstream along run 82 and then downstream along path 62 toward winder 68.

Vacuum chamber 132 is located under belts 122 between rolls 124 and 126. The chamber 132 is connected to a vacuum source and to a dump valve so that vacuum is supplied to the box for holding the lead end of a stiffener sheet fed along path 62 by belts 122. After the stiffener sheet has been wound into a coil by winder 68, the dump valve is actuated to increase the pressure in the chamber 132 to atmospheric pressure during feeding of the foil during winding of the roll.

Downstream extending foil transfer fingers 134 are provided on the top of chamber 132. The fingers extend between belts 122 past roll 126 and downstream to adjacent roll 136 in conveyor 74.

Vacuum transfer table 140 on the upper surface of chamber 138 supports core sheets 16 during movement on belts 122 along run to path 62. The table 140 extends between rolls 130 and 124. The vacuum chamber is connected to a vacuum source during feeding of core sheets to path 62. The box may be disconnected from the vacuum source after the stiffener core sheet has been fed to path 62 and during winding of foil into the roll.

Stiffener web cut off station 86 includes a fixed anvil 142 and a cutter blade on roll 146. A servo-actuated drive rotates roll 146 to cut core sheets 16 from web 152. Stiffener web pull roll 148 and idler roll 150 are located upstream from station 86. The pull roll is selectively rotated to feed sheet stiffener web 152 into machine 60.

Hold down wheels 154 are located above roll 130 to capture the free ends of sheet stiffener web fed into run 82. Web hold down fingers 156 and 158 extend along the upper surface of run 82 to prevent core sheets from lifting above run 82.

Figure 25:
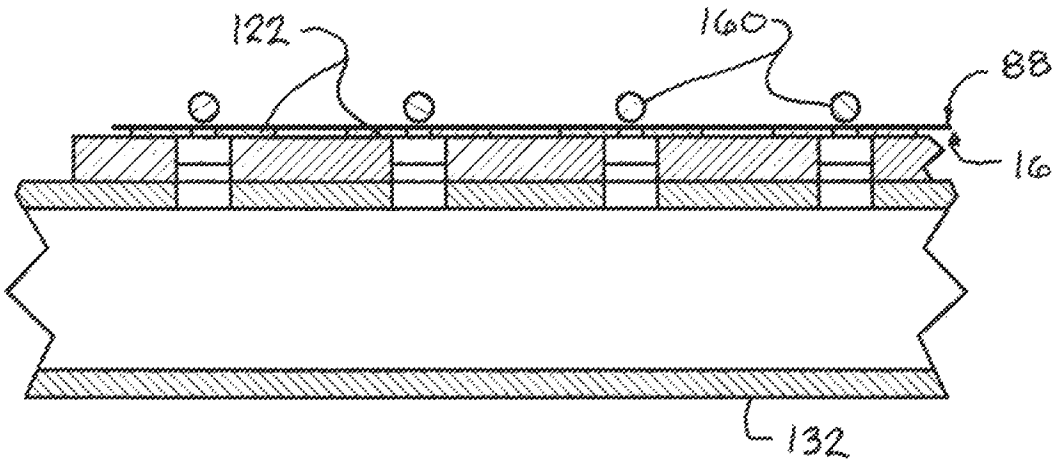
FIG. 25 is a sectional view taken along line K-K of FIG. 20.
Figure 26:
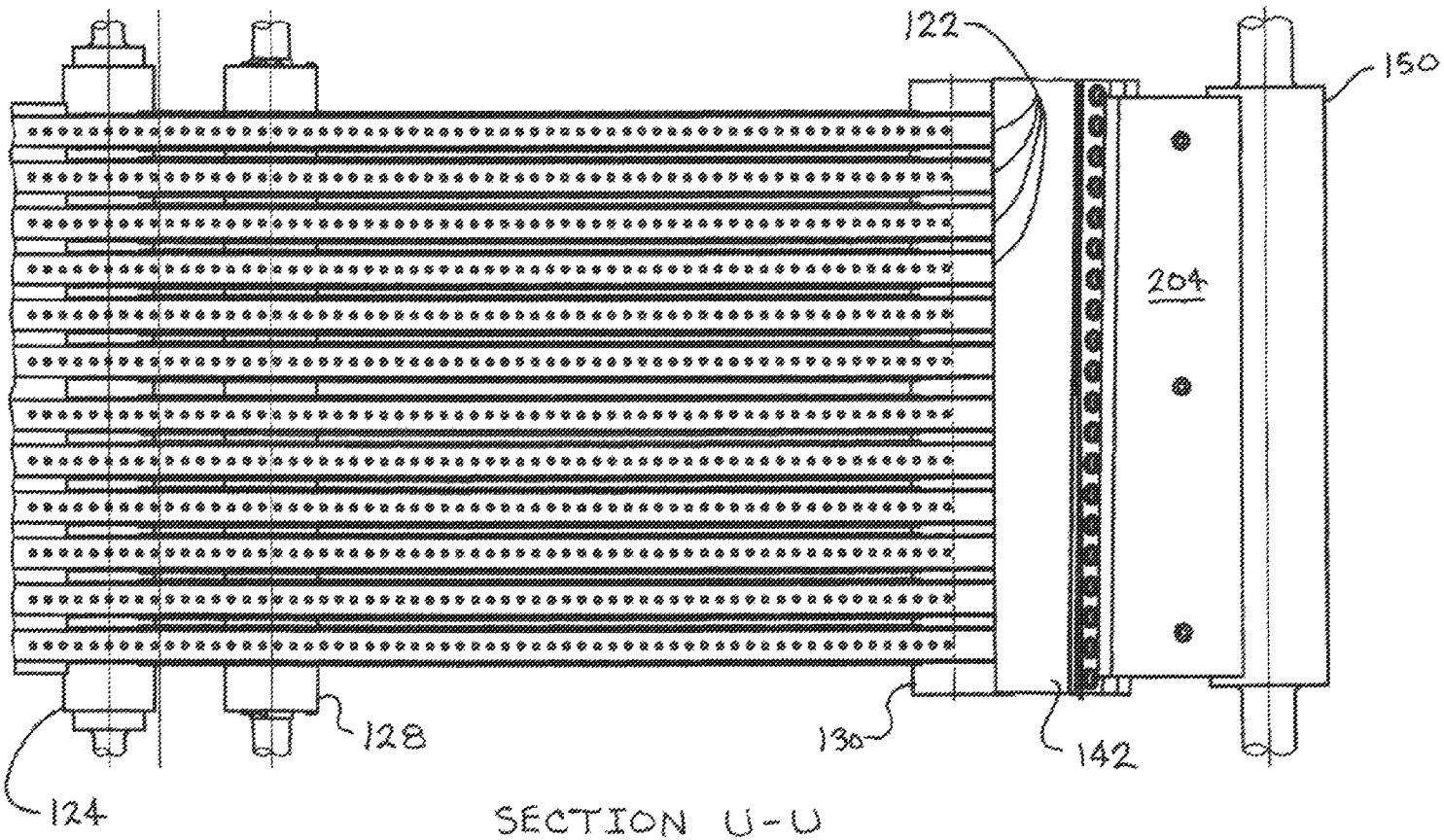
FIG. 26 is a sectional view taken along line U-U of FIG. 20.
Figure 27:
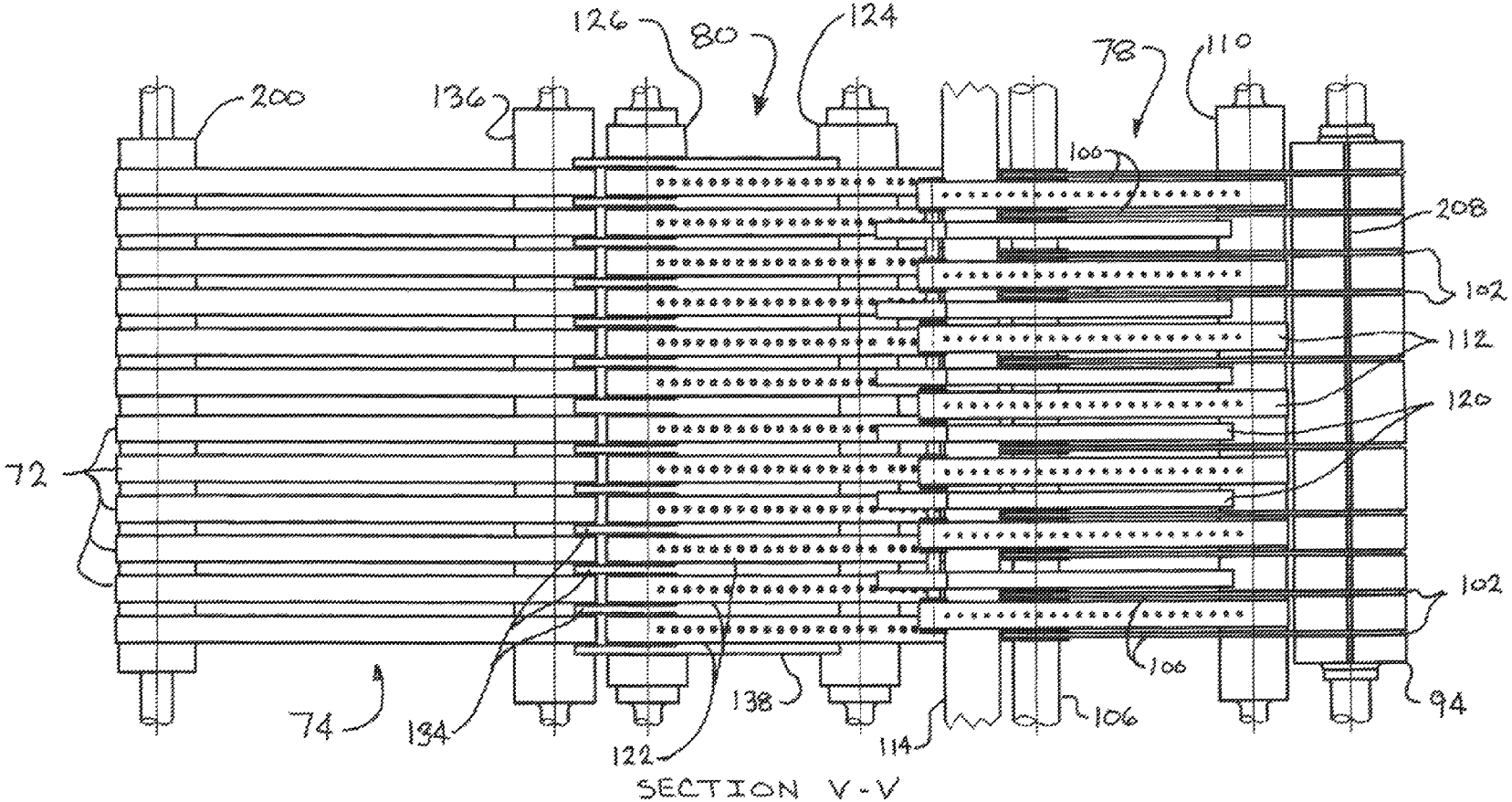
FIG. 27 is a sectional view taken along line V-V of FIG. 20.
Figure 28:
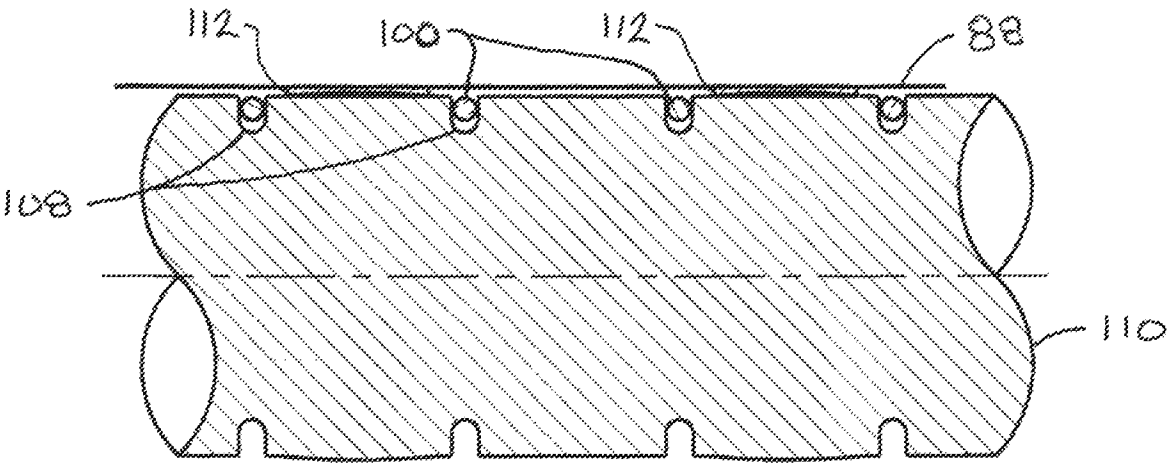
FIG. 28 is a sectional view taken along line M-M of FIG. 20.
Figure 29:
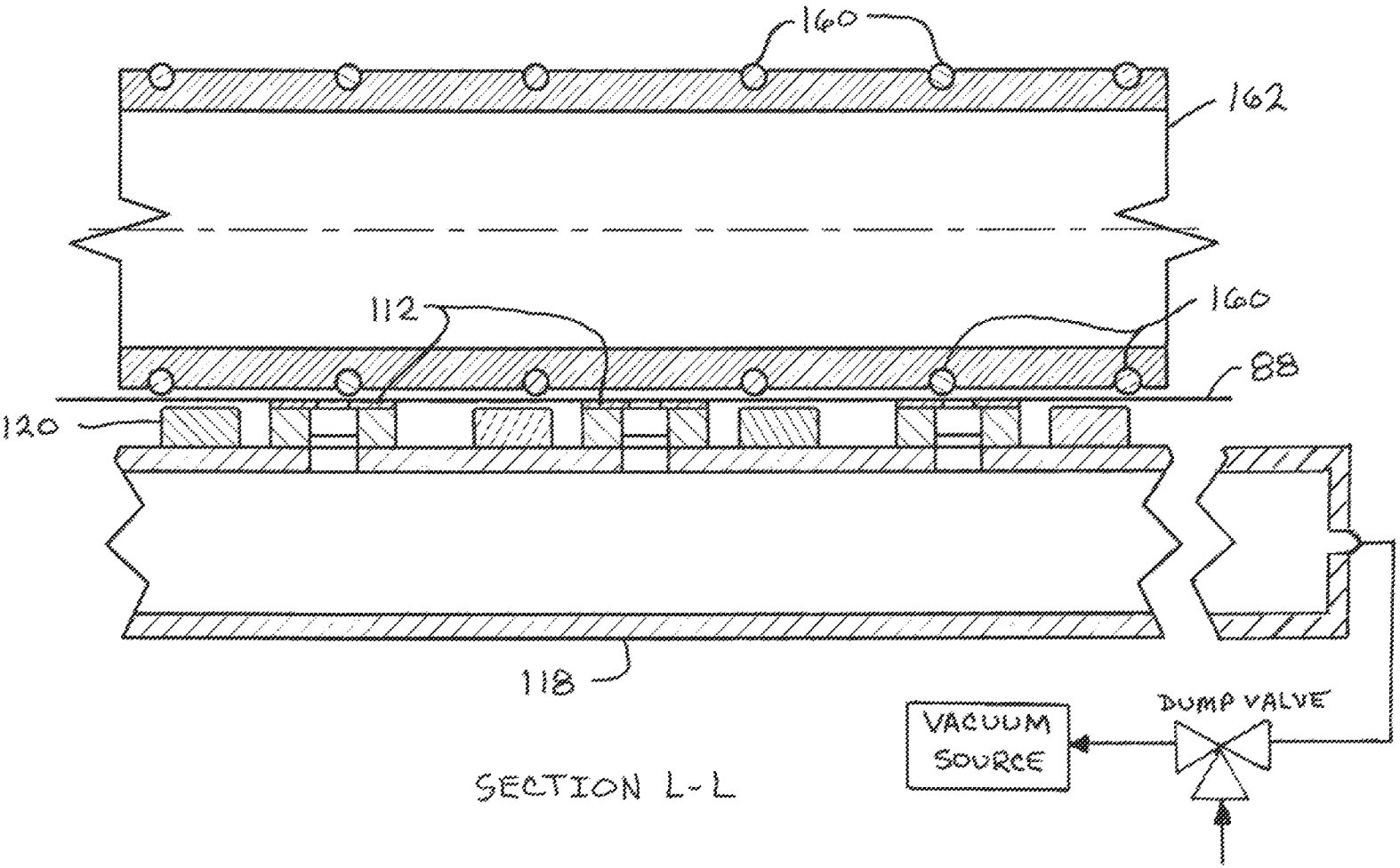
FIG. 29 is a sectional view taken along line L-L of FIG. 20.

Round hold down belts 160 are wound around rolls 162 and 164 located above feed path 62 to either side of roll 124. See FIGS. 15, 25, and 29. Belts 160 prevent the lead end of aluminum foil 88 from lifting above path 62. The belts also assure that the lead ends of core sheets which are fed along run 82 at an angle to path 62 are bent down to path 62 for capture by vacuum belts 122 as the belts move across vacuum box 132.

Back guide fingers 184 are located above transfer fingers 134 and above feed path 62. See FIGS. 15 and 21. Fingers 184 and fingers 134 cooperate to feed the lead ends of aluminum foil web and core sheets to rolling head 68.

Figure 21:
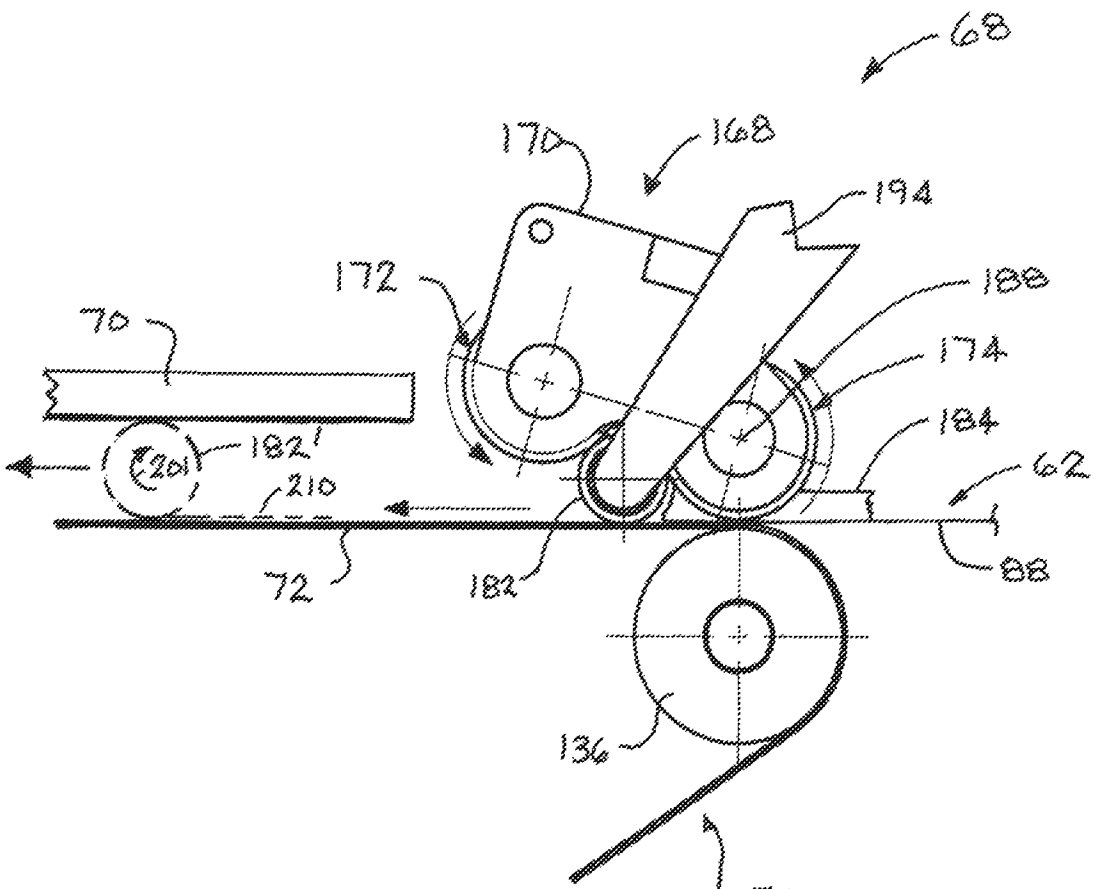
FIG. 21 is an enlarged side view of the coreless roll winder.
Figure 22:
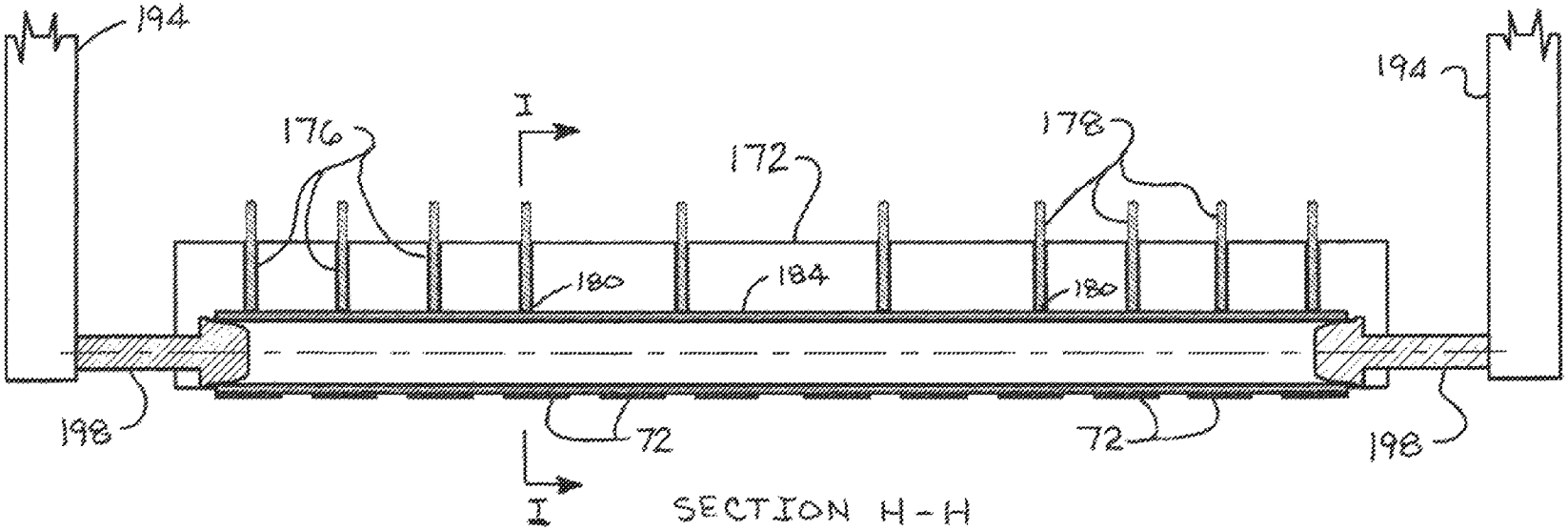
FIG. 22 is a sectional view of the roll winder taken generally along line H-H of FIG. 20.
Figure 23:
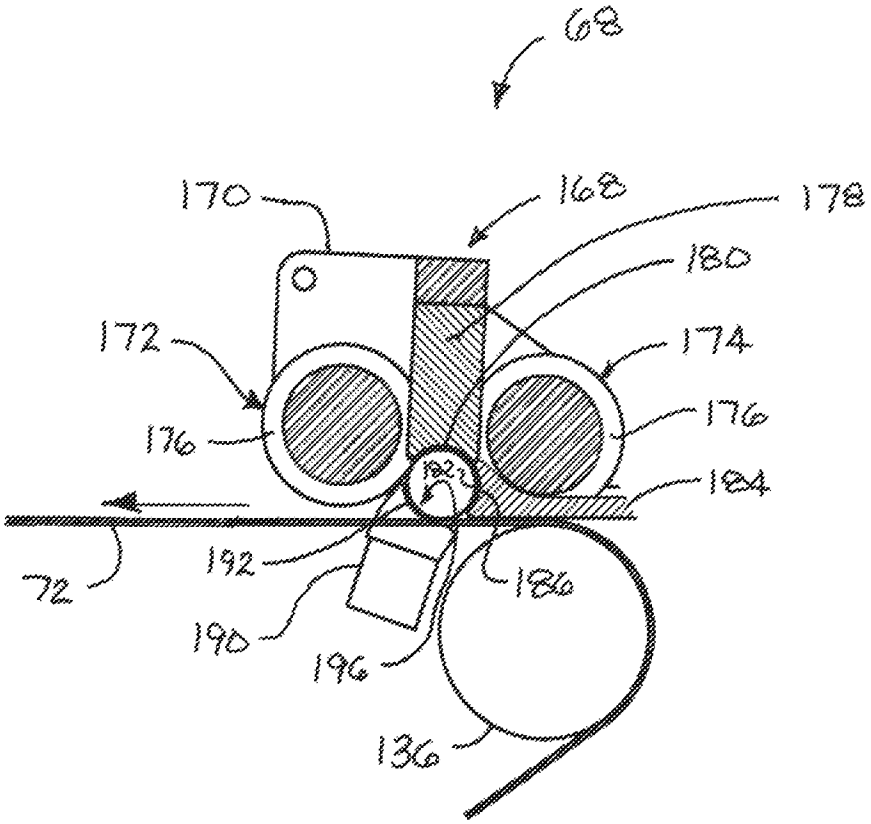
FIG. 23 is a sectional view taken through the roll winder along line I-I of FIG. 22.
Figure 24:
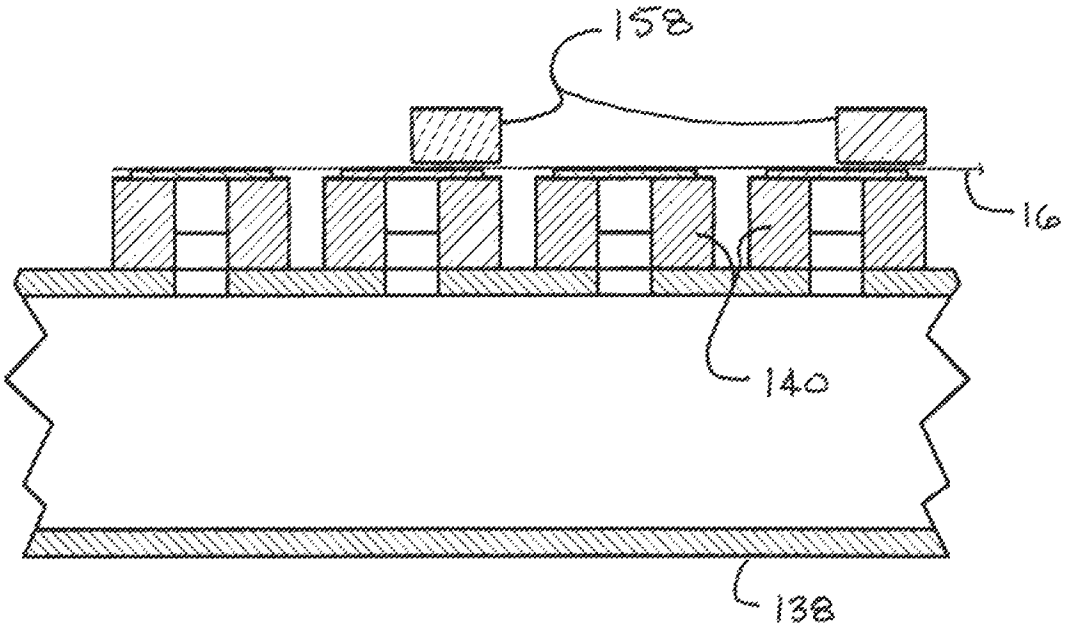
FIG. 24 is a sectional view taken along line R-R of FIG. 20.

Rolling head 68 extends across feed path 62 downstream from rolls 126 and 164. Rolling head 68 is illustrated in FIGS. 21, 22 and 23 and includes an assembly 168 located above feed path 62 including a pivot arm 170, and front and rear winding rollers 172 and 174 which extend transversely across path 62. A number of circumferential slots 176 are provided in rollers 172 and 174 as illustrated in FIG. 21. Assembly 168 includes a plurality of thin top guide fingers 178 which extend downwardly between rollers 172 and 174. The edges of the guide fingers 178 are fitted in slots 174 and 176. See FIGS. 22 and 23. The lower ends 180 of fingers 178 are concave to guide winding of the stiffening web core sheets 16 and aluminum foil into roll 182 wound in winder 68.

Assembly 168 is mounted on a support (not illustrated) rotatably mounted to the frame of machine 60 for rotation of the assembly about the longitudinal axis 188 of roller 174. An extendable and contractible drive (not illustrated), such as a power cylinder, rotates the assembly up about axis 188 during winding of roll 182 and during release of the roll from the assembly.

The rolling head 68 also includes a number of front guide fingers 190 spaced across path 62 beneath assembly 168. A finger 190 is located between each adjacent pair of flat bottom belts 72. Belts 72 are shown in FIG. 22. One finger 190 is shown in FIG. 23. Each finger 190 has a concave upper end surface 192 which is positioned above belts 72 and adjacent concave surfaces 180 and 186 when the fingers are extended to the upper position between the belts as shown in FIG. 23. These surfaces, and the surfaces of rollers 172 and 174, define a cylindrical recess 196 for winding the stiffening web sheet and foil into the roll core.

A front guide fingers drive (not illustrated) is operable to extend the front guide fingers 190 to an elevated position between belts 72 as shown in FIG. 23 and to retract the fingers below the belts during discharge of a roll from rolling head 68.

Rolling head 68 includes a pair of winding cone pivot arms 194 extending down from the frame of machine 60 with lower ends located to either end of the cylindrical roll winding recess 196. A non-driven rotary winding cone 198 extends inwardly from the end of each arm 194 into recess 196. The initial windings of the stiffener core sheet are wound around the surfaces of the cones. The cones stabilize the roll 182 in the winder during winding of the aluminum foil. The cones are slightly biased toward the roll to seat the cones in the wound stiffener core sheet. The cones rotate freely with the roll during winding. After winding has been completed and prior to discharge of a roll 182 from winder 68, arms 194 are moved outwardly from the roll to withdraw the winding cones from the ends of the stiffening core.

Belts 72 are moved downstream past rolling head 68 and to discharge location 66 at a speed greater than the speed at which core sheets and foil are fed to winder 68. High speed belts 72 accelerate tail roll up after the foil has been cut at station 64. High speed winding of the foil into the roll at winder 68 creates gap or separation 214 between the trailing end and lead ends of the foil 210, 212 formed when the foil is cut.

As the roll is wound and increases in diameter, winding assembly 168 is rotated upwardly about the axis 188 from the initial position shown in FIG. 23 to position in FIG. 21. Upward rotation of the assembly moves the roll away from back guide fingers 184. Front guide fingers 190 are withdrawn. The outer surface of the roll moves away from the guide surface on the fingers 178 and 184 but maintains large area contact with the winding rollers 172 and 174 and belts 72. The rollers are connected to rotary drives which rotate the rollers at a circumferential speed equal to or greater than the speed at which the stiffening web and foil are fed along path 62 to the roll winder. The speed of the winding rollers may be adjusted to suit the characteristics of the foil web material. Winding roller circumferential speed is generally greater than or equal to the foil web speed along path 62 and less than the speed of belts 72.

After winding of the stiffening web core sheet into the roll core, with inter-winding of the lead end of the aluminum foil web, the speed at which aluminum foil is delivered to the winder and the winding speed may be increased during winding of the foil on the roll. The feed speed may be decreased immediately prior to discharge of the roll 182 from winder 68.

The roll is discharged from the winder 68 shortly before the full length of foil is wound into the roll. A trailing end or tail 210 of the foil extends upstream along feed path 62 from the roll. In this position, roller 172 has been elevated to a position where the lower surface of the roll is at the level of the lower surface of friction bars 70. Further upward rotation of assembly 168 releases the partially wound roll from the winder for downstream movement with belt 72. The top of the roll 182' frictionally engages the lower surfaces of bars 70 so that the belt 72 rotates the roll in the direction of arrow 201 shown in FIG. 21 during movement away from winder 68. This rotation winds the foil tail 210 into the roll 182' to complete roll winding before the roll reaches discharge location 66 at the end of feed path 62 and bar 70.

The operation of winding machine 60 will now be described with particular reference to FIGS. 15-19.

In FIG. 15, the core sheet for the roll has been fed to winder 68 and wound to form a cylindrical core for roll 182. The lead end of aluminum foil web 88 has then been fed into the winding assembly and wound into the assembly over/inwardly from the remaining portion of the core sheet to form the core. FIG. 15 illustrates the position of machine 60 during winding of remaining aluminum foil into roll 182 shortly before completion of winding. The foil is pulled along feed path 62 and into the roll 182 by power-rotated winding rollers 172 and 174 and belts 72. Guide fingers 190 have been retracted below belts 72. All of the belts located on feed path 62 are moved in a downstream direction at the feed speed for web 88 along straight feed path 62. Vacuum chambers 118 and 132 are at atmospheric pressure so that the delicate foil is not subjected to pressure differential forces and deformation or bending as the foil moves straight to the roll. The lower runs of belts 160 are above the foil. Fingers 184 are located a slight distance above the foil to avoid deforming contact with the foil. The foil is pulled freely along path 62 by winder 68 without deformation. It is wound smoothly into the roll. The winding rolls 172 and 174 engage the outside of the foil roll along the entire length of the foil roll, with the exception of narrow finger slots 176, to wind the foil into the roll without deformation.

After initial winding of the core, with the inter-wound lead end of the foil captured in the core, the upward rotation of winding assembly 168 moves the roll 182 away from back guide fingers 184. The increased diameter of roll 182 moves the roll away from top guide fingers 178. Compare FIGS. 23 and 21. Movement of the roll 182 away from narrow guide fingers during winding of the foil strip on the core and retraction of fingers 190 permit the foil to be wound without deformation caused by contact between the delicate foil and the fingers.

FIG. 15 illustrates that stiffener web pull roll 148 has been actuated to feed the lead end of the stiffener web 152 through a slot between spaced transfer plates 204 and 206 located between the pull roll and cut off station 86. The lead end of the stiffener web has been fed beneath the upstream end of hold down fingers 156 for capture between belts 122 and the hold down bar and wheels 154.

Figure 16:
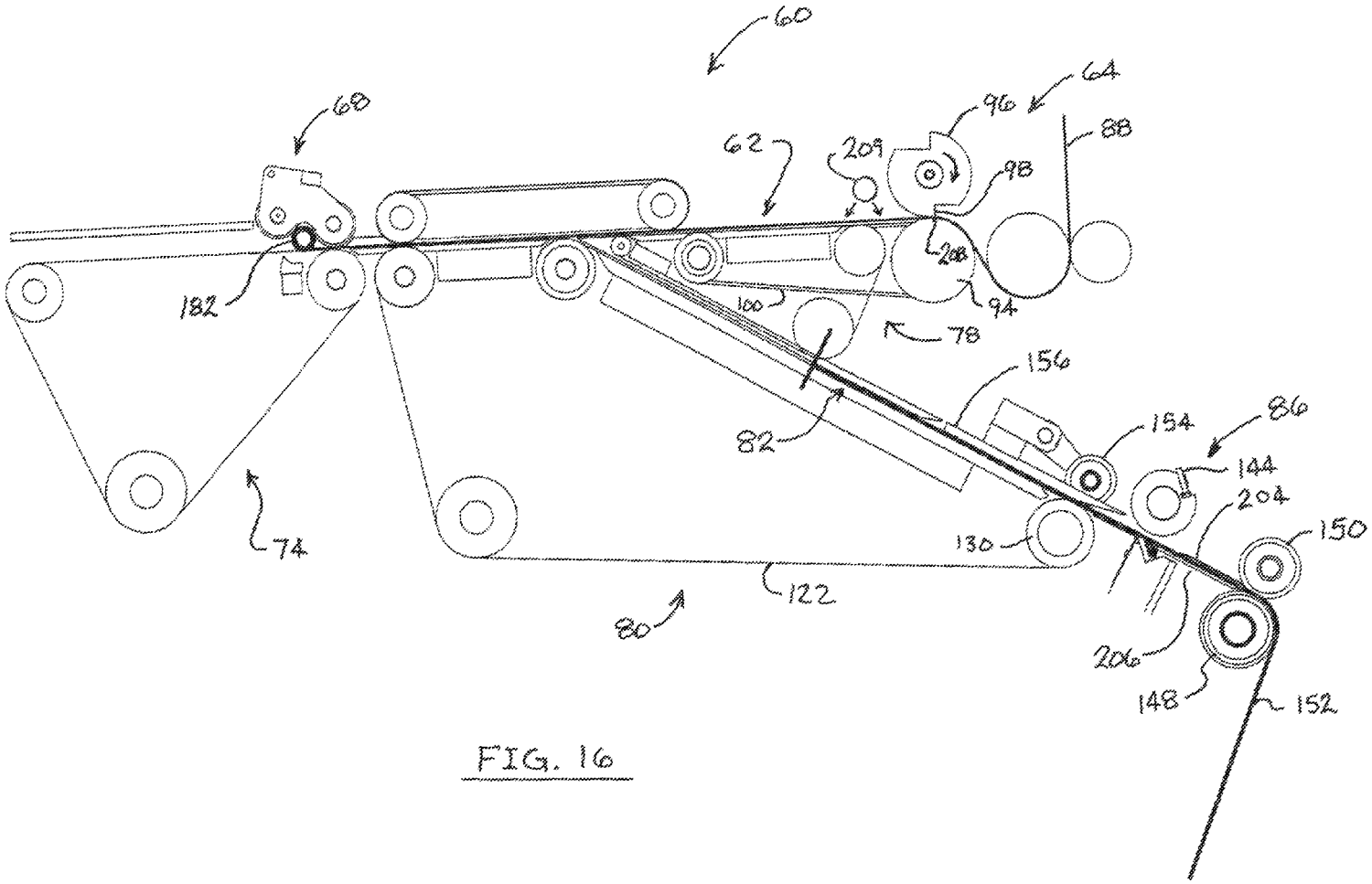

In FIG. 16, pull roll 148 is feeding the sheet stiffener web along the feed run 82 toward path 62. Winder 68 continues to wind aluminum foil 88 onto roll 182. Continuously rotating cutter roll 96 is then lowered so that blade 98 is extended into cut slot 208 in roll 94 to sever the aluminum web. After the web is severed, rotating roll 96 is raised to the position of FIG. 15. Round belts 100 are located in deep grooves 102 in roll 94 below blade 98 and are not injured during cutting of the foil web. The downstream end of the foil web continues to be pulled downstream and wound into roll 182. The new end of the foil web is fed around roll 94 and is stripped from the roll onto the top runs of downstream moving round belts 100 as previously described.

Air jet manifold 209 extends across feed path 62 between rolls 94 and 110. Downward air jets from manifold 209 push the lead end of the web against belts 100 to assist feeding of the lead end of the foil to roll 110 and belts 112 over vacuum box 118 for vacuum capture of the foil on belts 112. See also FIG. 31.

Figure 17:
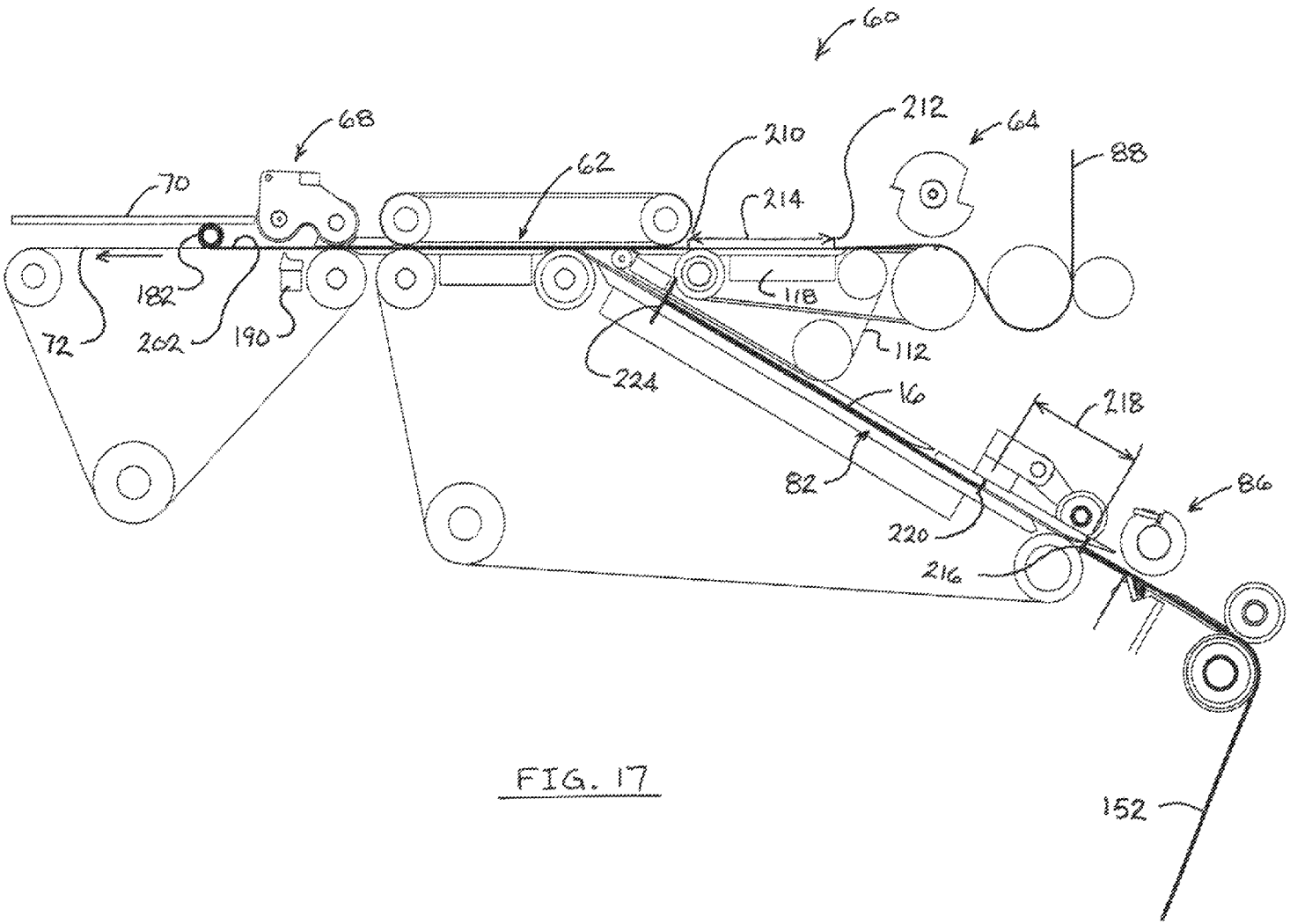

FIG. 17 illustrates the position of winding machine 60 after further rotation of winder 68, release of roll 182 for downstream rotation against bars 70 by belts 72 and initial winding of the foil tail 210 into the roll. Winding of the foil tail into the roll pulls the trailing end of the foil 210 downstream along path 62 faster than lead end 212 is moved along the path causing a separation 214 between the ends. The lead end 212 of the foil is moving onto vacuum chamber 118 for vacuum capture on belts 112.

Between the positions of FIG. 16 and FIG. 17, stiffener cut off station 86 was actuated to cut a core sheet 16 from web 152 for feeding along feed run 82 toward feed path 62. The pull roll 148 is then deactivated with the stiffening web lead end 216 located just upstream of roll 130 and pull down wheels 154. Feed of the severed stiffening web segment 16 along run 82 forms a gap 218 between stiffening web lead end 216 and core sheet trailing end 220. Vacuum chamber 138 holds web sheet 16 on vacuum belts 122 for movement along run 82 toward feed path 62. The lead end 224 of sheet 16 is located a short distance below the junction between run 82 and path 62.

In FIG. 17, roll 182 has been discharged from the roll winder which has been rotated down to the winding position to receive the lead end of sheet 16 for winding the next core.

Figure 18:
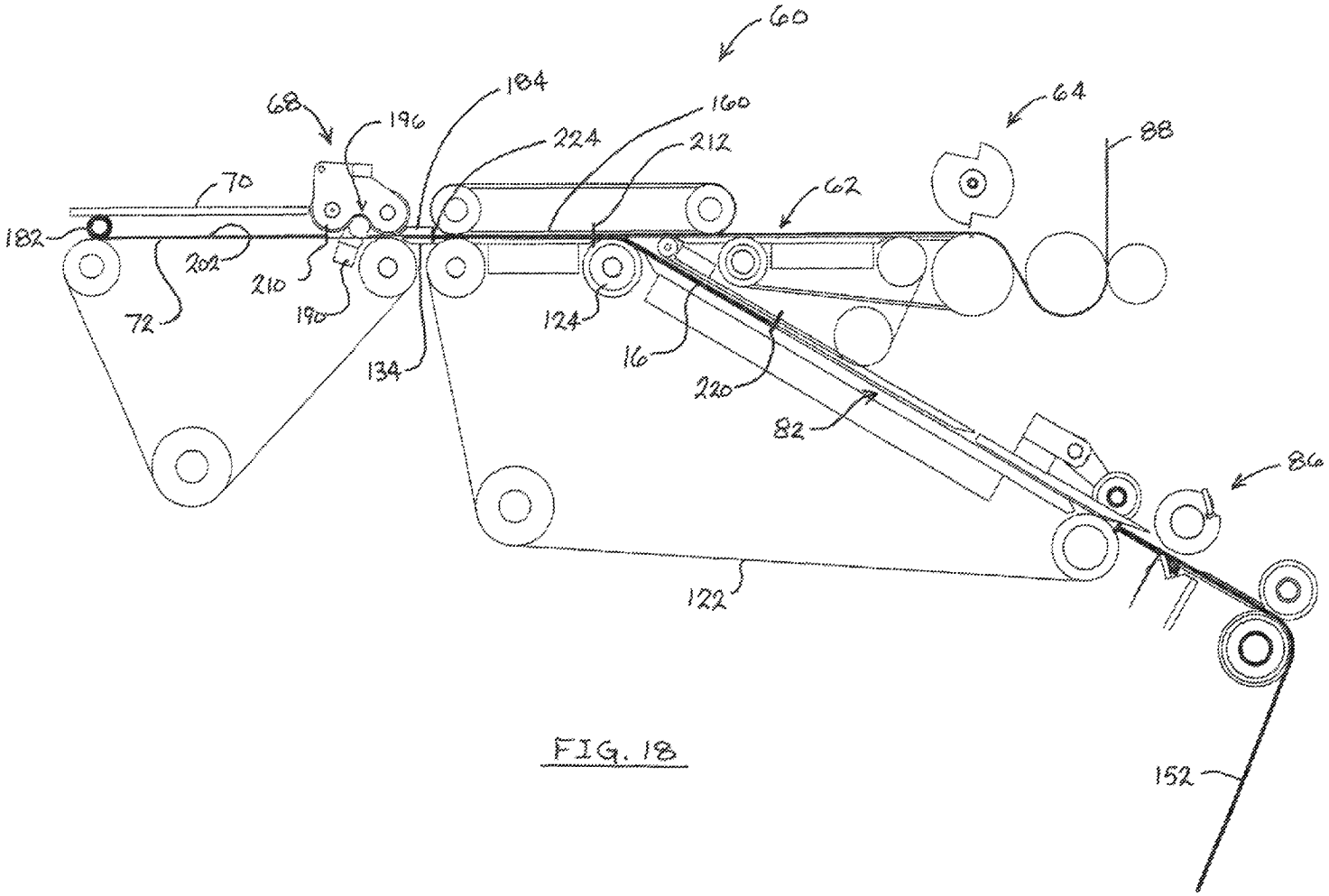

In FIG. 18, roll 182 has been rotated downstream against bars 70 and the tail has been wound onto the roll sufficiently to move tail trailing end 210 beyond winding recess 196 in lowered winder 68. After the trailing end 210 has moved beyond recess 196, front guide fingers 190 are elevated between belts 72 to receive the lead end 224 of sheet 16 when the sheet is fed to recess 196. Continued downstream feeding of roll 182 winds tail 202 into the roll to complete winding of the roll. Bars 70 and the upper runs of belts 72 may extend further to the left beyond the positions illustrated in FIGS. 15-19 to complete winding of the tail into the roll before discharge from machine 60.

In FIG. 18, the severed stiffening sheet 16 has been moved along run 82 to path 62 where the lead end of the sheet engaged the lower runs of round hold down belts 160 and was bent through the shallow angle from run 82 to path 62. The resiliency of the stiffener web material, which may be Kraft paper, permits elastic bending of the segment around roll 124 at the junction of run 82 and path 62 without deforming the sheet.

After approximately one-half the length of the sheet 16 has been moved downstream onto path 62 from the intersection with run 82, the lead end 212 of the foil web is moved along path 62 on top of sheet 16 between belts 160 and 122. The foil web and the sheet are carried downstream together toward winding recess 196 without deforming the aluminum web. The aluminum web rests on the moving sheet and is carried downstream with the sheet. Both the foil and sheet are fed downstream at the same speed. Belts 160 run slightly above the foil and do not contact or deform the foil. The vacuum from chamber 132 holds the sheet 16 against belts 122 but does not engage the foil. The lead end 224 of the sheet is fed between fingers 134 and back guide fingers 184 as illustrated in FIG. 18.

Figure 19:
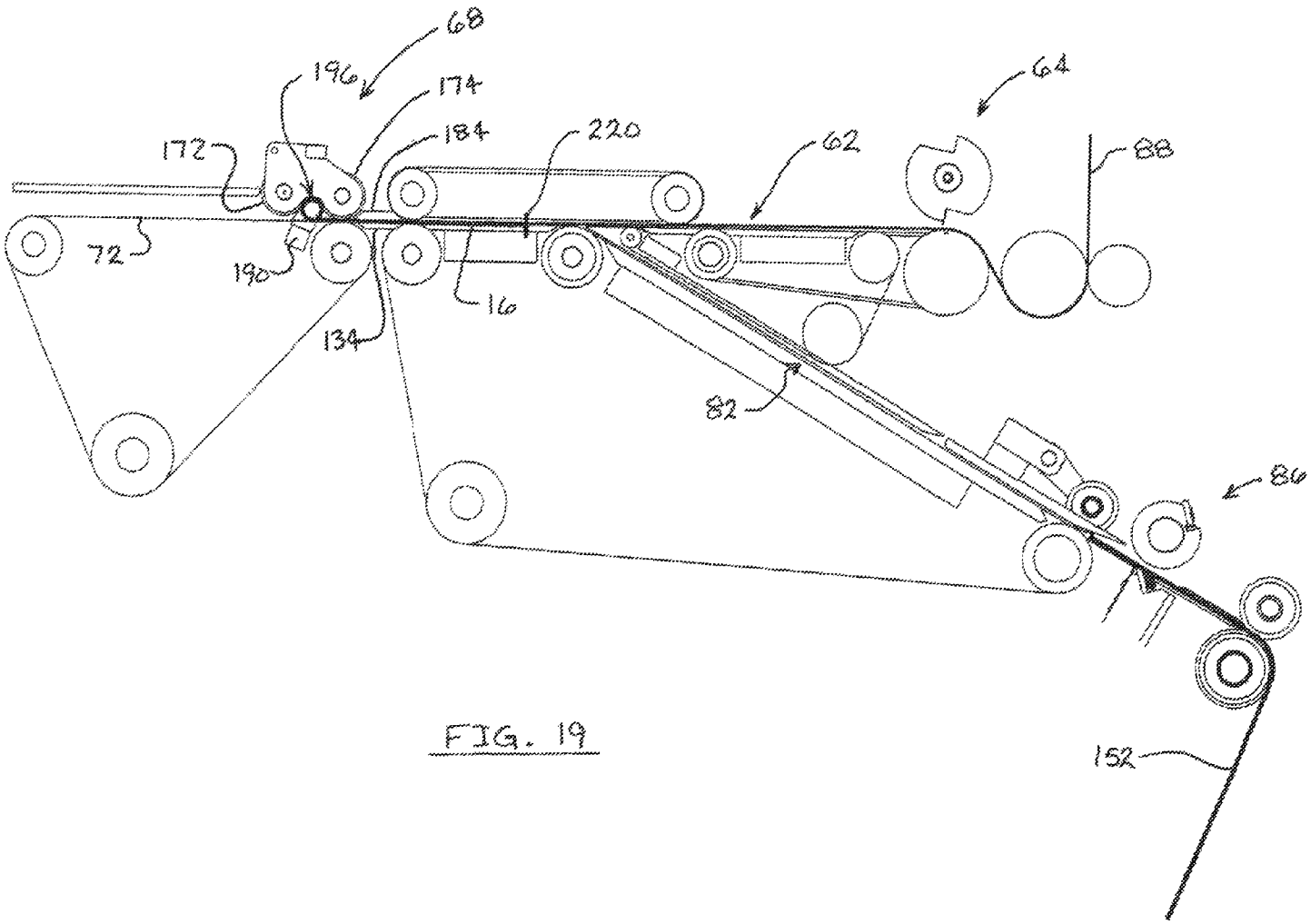
Figure 20:
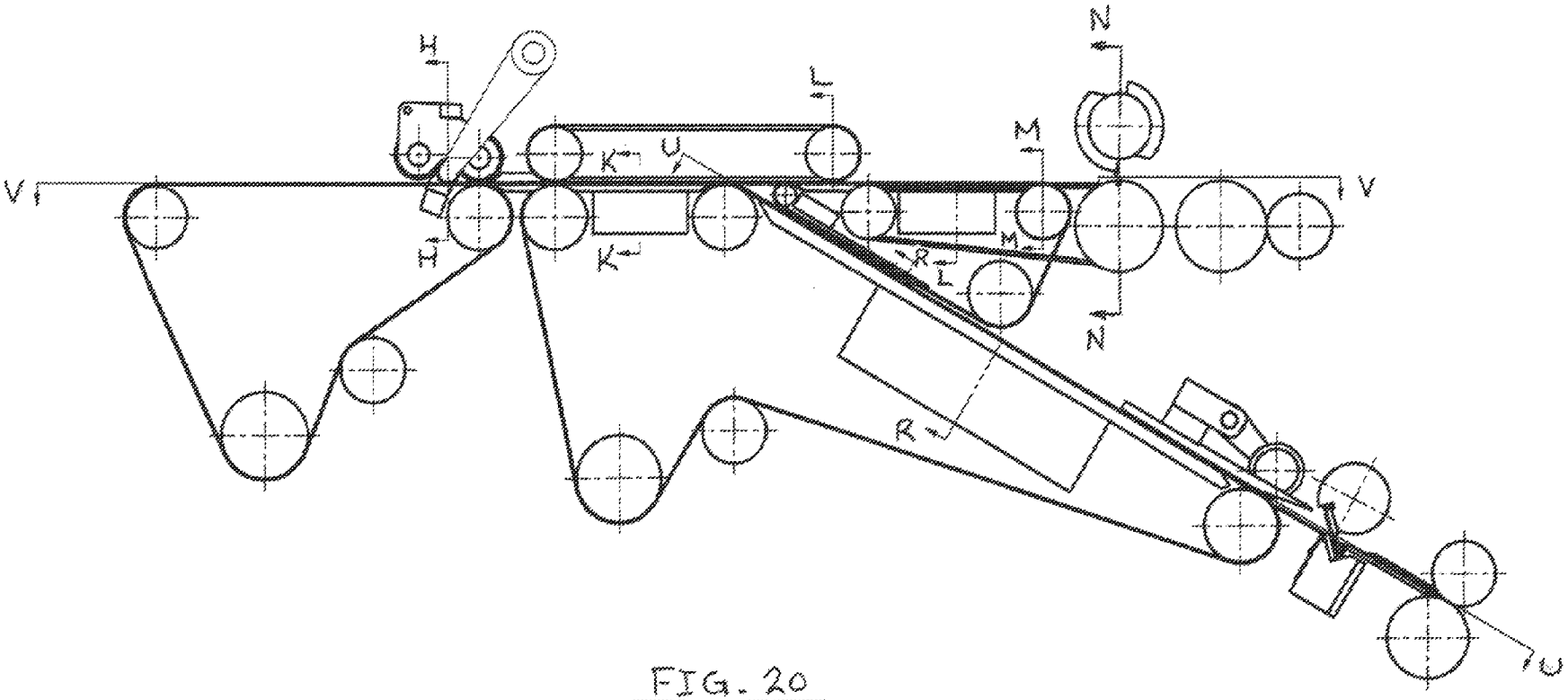
FIG. 20 is a side view of the machine illustrating section lines for subsequent described figures.

In FIG. 19, the lead portion of the stiffener sheet 16 has been fed into winding recess 196 and has been wound to form the inner portion of spiral stiffener core 12. The lead end of the foil web on top of the tail of sheet 16 has been wound into the core on top of the tail of sheet 16. The segment trailing end 220 has been moved from run 82 to path 62. Extended front guide fingers 190 guided the lead end 224 of sheet 16 into recess 196 for winding to form spiral stiffener core 12 as previously described.

Continued downstream feeding of the stiffener core sheet 16 and aluminum foil web 88 will complete winding of the spiral core with the lead end of the foil spirally wound in the outer portion of the core. During winding of the core, the strong, resilient stiffening web sheet 16 engages fingers 190, roll 172, fingers 178 (see also FIG. 23), roll 174 and fingers 184. The stiffener web sheet 16 protects the lead end of the aluminum foil 88 from direct contact with these members to assure that the foil is not deformed during winding of the core. Contact with the fingers may deform the foil and result in permanent deformation which causes an unsightly and unacceptable wound foil roll. Winding of the sheet 16 on both sides of the foil forms a friction connection holding the foil in the core and permitting winding of foil web onto the roll body 14.

After all of the stiffening web sheet 16 has been wound into recess 196, continued operation of winding machine 60 winds aluminum web 88 onto the spiral core to form wound foil body 14. During this winding, belts 72 and rolls 172 and 174 rotate the growing foil roll as web is fed to and wound onto the roll. The belts and rolls contact the web at large surface areas under relatively low pressure and do not permanently deform the web.

During operation of winding machine 60, aluminum foil web may be fed along path 62 at a roll starting speed or a roll winding speed. These speeds may be adjusted to suit the foil web material being wound. Stiffening core sheet is fed into the machine at the roll starting speed only at a time when the foil web is being fed at the starting speed. The winding speed is equal to or greater than the starting speed. Foil web speeds may range between 400 and 1,000 feet per minute or more depending on the foil characteristics. The roll starting speed is generally at the low end of the speed range.

During winding of the aluminum foil body 14, the web is fed into machine 60 by feed pull roll 90 and is wound into the roll by winder 68 at the same speed. At this time, the vacuum boxes 118 and 132 are at atmospheric pressure and do not exert forces on the web as the web is rapidly wound onto the roll.

Winding of the aluminum web into the roll at recess 196 returns winding machine to the position of FIG. 16 and completes the one cycle of operation for winding a roll 10 (as shown in FIG. 1).

During operation of winding machine 60, vacuum chamber 118 is maintained at a slight negative pressure sufficient to hold the foil web against the vacuum without deforming the foil during feed of the lead end of the foil along path 62 until the foil is wound into the roll at recess 196. At this time, the pressure in box 118 is dumped and increased to atmospheric pressure.

During feed of stiffener sheet 16 along run 82 the vacuum chamber 138 is maintained at a negative pressure sufficient to hold the sheet 16 on belts 122 without deforming the stiffener sheet. During feeding of segment 16 along path 62 past vacuum chamber 132, the pressure in chamber 132 is maintained at a slight negative pressure sufficient to hold the stiffener sheet against belts 122 without deforming the stiffener sheet.

The aluminum foil wound into roll 10 preferably has a thickness between 0.00043 inches and 0.001 inches.

The core sheets 16 are preferably formed from strengthened Kraft paper. This paper has a stiffness greater than Kraft paper of the type used for grocery bags. The Kraft paper may be from 0.008 inches to 0.010 inches thick.

The foil is wound into rolls at a tension of about 1 to 1.5 pounds for each inch of web width. A 12 inch wide web would be wound at a tension of 12 to 18 pounds.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the inventions.

Having thus described the invention, what is claimed is:

1. An apparatus for winding a foil roll with a wound stiffener core comprising:

a foil web supply for providing an elongate web of foil material to said apparatus, said foil web having a feed end;

a stiffener supply for providing a sheet of stiffener material to said apparatus, said stiffener material having a leading edge and a trailing edge;

a foil feed conveyor configured for transporting said foil web downstream along a foil feed path at a first speed;

a sheet stiffener feed conveyor to transport said stiffener sheet along a stiffener feed path to merge with said foil feed path at an angled intersect, operation of said sheet stiffener feed conveyor being coordinated with operation of said foil feed conveyor to position said leading edge at said foil feed path intersect ahead of said feed end; and a roll winder configured for receiving from said foil feed path downstream of said intersect and spirally winding said foil web and said stiffener sheet about a central axis into a wound stiffener core, said roll winder having a plurality of movable roll starter guide fingers defining a generally cylindrical roll winding recess for directing said stiffener sheet and said foil web from said foil feed path into said roll winder and initiating core winding when in a first position, said stiffener sheet and said foil web entering said roll winder coextensively with said leading edge entering said roll winder ahead of said feed end, said foil web positioned between said central axis and said stiffener sheet, said stiffener sheet in adjacent contact with said foil web such that said stiffener sheet prevents contact of said leading portion with said roll winder, said roll winder further having at least two winding rollers having circumferential surfaces equidistantly displaced from said central axis and configured to rotate said foil roll by circumferential contact with said foil roll to spirally wind said foil web and said stiffener sheet.

2. The apparatus of claim 1, wherein said angled intersect formed between said foil feed path and said stiffener feed path is an acute angle.

3. The apparatus of claim 1, wherein said feed end is displaced from said leading edge by at least the circumference of a first winding of said stiffener sheet.

4. The apparatus of claim 1, further comprising a foil web cutting mechanism.

5. The apparatus of claim 4, wherein said foil web cutting mechanism is configured to intermittently sever said foil web to form a series of foil web segments each having a feed end, a tail end, and a selective, predetermined foil length therebetween.

6. The apparatus of claim 5, wherein said foil web cutting mechanism comprises parallel cutter and anvil rolls positioned adjacent opposing surface of said foil web, said cutter and anvil rolls selectively relatively moveable into a first position to transversely sever said foil web, and a generally opposing second position allowing said foil web to pass between said rolls unsevered.

7. The apparatus of claim 6, wherein said foil web is in adjacent contact with a portion of a peripheral roll surface said anvil roll.

8. The apparatus of claim 7, further comprising a feed end guide apparatus having a plurality of foil transfer belts partially encircling said anvil roll and extending at least to said foil transfer conveyor, said foil transfer belts configured to direct said feed end from said peripheral roll surface toward said foil feed conveyor.

9. The apparatus of claim 8, wherein said feed end guide apparatus further comprises a plurality of apertures in said peripheral roll surface to which a vacuum source is intermittently applied to maintain said foil web in in adjacent contact with a portion of a peripheral roll surface.

10. The apparatus of claim 4, wherein said roll winder is movable between a winding position and a roll discharge position, said apparatus further comprising a roll discharge conveyor configured for receiving said foil roll from said winder following severing of said foil web to form said tail end of said foil web segment downstream and said feed end of said foil web segment upstream by said foil web cut-off mechanism and movement of said roll winder toward said roll discharge position, said discharge conveyor moving said foil roll from said roll winder at a speed greater than said first speed thereby creating a foil web gap between said tail end downstream and said feed end upstream along said foil feed path.

11. The apparatus of claim 10, wherein said roll winder is configured to relatively reposition said roll starter guides during roll winding such that said roll starter guides are moved from contact with said foil roll before said trailing edge enters said roll winder.

12. The apparatus of claim 11, wherein said at least two winder drive rolls are driven at a circumferential speed equal to said first speed during foil roll winding.

13. The apparatus of claim 12, wherein said roll discharge conveyor further comprises a first discharge friction surface and a spaced-apart second discharge friction surface configured to allow said foil roll to pass in circumferential contact therebetween when discharged by said roll winder, said first and second discharge surfaces relatively moveable to cause rotation of said foil roll.

14. The apparatus of claim 13, wherein said first discharge friction surface is a movable conveyor belt and said second discharge friction surface is a stationary surface arranged parallel to said moveable conveyor belt.

15. The apparatus of claim 14, wherein said foil roll is in circumferential contact with said movable conveyor belt and said at least two winder drive rolls during foil roll winding.

16. The apparatus of claim 15, wherein said first discharge friction surface is movable at a plurality of pre-determined speeds, one of said plurality of speeds being greater than said first speed.

17. The apparatus of claim 16, wherein said first speed may be varied among a plurality of pre-determined speeds.

18. The apparatus of claim 10, wherein said roll winder further comprises a pair of movable winding cones located at either end of said roll winding recess, said movable cones movable between a first position in which said cones engage the ends of said wound stiffener core to bias said core along said central axis, and a second position in which said cones are disengaged from said wound stiffener core sufficiently to allow movement of said foil roll from said roll winder.

19. The apparatus of claim 10, wherein said stiffener supply is configured to provide an elongate web of stiffener material to said sheet stiffener feed conveyor and said apparatus further comprises a stiffener web cut-off mechanism disposed along said stiffener feed path configured for intermittently severing said stiffener web to form a plurality of stiffener web segments of a predetermined stiffener length, each stiffener web segment having a leading edge and a trailing edge, said stiffener length being less than said foil segment length.

20. The apparatus of claim 19, wherein said sheet stiffener feed conveyor is coordinated to feed said leading edge into said foil web gap.

21. The apparatus of claim 4, wherein said foil feed conveyor further comprises a feed end guide configured to bias said foil feed end for movement from said foil web cutting mechanism toward said feed path intersection.

22. The apparatus of claim 21, wherein said feed end guide further comprises an apertured foil feed belt moving along said foil feed path adjacent to said foil web at said foil feed rate, and a vacuum source selectively connectible to said apertured foil feed belt in a manner to engage said foil web to bias movement of said foil web along said foil feed path in unison with said aperture foil feed belt when said vacuum source is connected, and said foil web may relatively move against said aperture belt when said vacuum source is not connected.

23. A method for winding a foil roll with a wound stiffener core comprising the steps of:

providing an elongate web of foil material having a feed end;

providing a sheet of stiffener material having a leading edge and a trailing edge;

providing a foil feed conveyor configured for transporting the foil web downstream along a foil feed path at a feed rate;

providing a sheet stiffener feed conveyor configured for transporting the stiffener sheet along a stiffener feed path to merge with the foil feed path at an angled intersect;

providing a roll winder configured to receive from the feed path downstream of the feed path intersect the stiffener sheet and the foil web in adjacent contact therewith, the roll winder having at least two winding rollers with circumferential surfaces equidistantly displaced from a central axis;

providing a plurality of movable roll starter guide fingers defining a generally cylindrical roll winding recess for directing the stiffener sheet and the foil web from the feed path into the roll winder;

feeding the foil web along the foil feed path at the feed rate;

coordinating operation of the stiffener feed mechanism with operation of the foil feed mechanism to position the stiffener leading edge at the foil feed path intersect downstream of the foil feed end;

positioning the plurality of roll starter guide fingers in a first position to contact the stiffener sheet and direct the stiffener sheet and adjacent foil web into the roll winder;

receiving by the roll winder the foil web and the stiffener sheet in adjacent, coextensive contact;

spirally winding about the central axis by circumferential contact between the at least two winding rollers the stiffener sheet and the coextensive foil web into a wound stiffener core, the stiffener sheet being outwardly relatively disposed of the foil web;

repositioning the plurality of roll starter guide fingers to a second position in which the guides are not in contact with the stiffener sheet prior to entrance of the trailing edge into the roll winder; and spirally winding by the roll winder the foil web extending beyond the stiffener sheet trailing edge.

24. The method of claim 23, further comprising the steps of:

providing a foil web cutting mechanism upstream of the foil feed path;

providing a movable roll winder movable between a winding position and a roll discharge position;

providing a roll discharge conveyor configured for receiving the foil roll from the winder following severing of the foil web to form the tail end of the foil web segment downstream by the foil web cut-off mechanism and movement of the roll winder toward the roll discharge position, the discharge conveyor configured to move the foil roll from the roll winder at a speed greater than the feed rate thereby creating a gap between the tail end downstream and the feed end upstream along the foil feed path intermittently severing by the cutting mechanism the foil web to form a series of foil web segments moving downstream along the foil path toward, each foil web segment having a downstream feed end and an upstream tail end defining a foil length therebetween;

positioning the roil winder to the roll discharge position as the cutting mechanism severs the foil web;

operating the discharge conveyor at a discharge speed greater than the teed rate; and positioning the roll winder to the winding position in preparation to receive the leading edge of a next stiffener sheet.

25. The method of claim 24, further comprising the steps of:

supplying an elongate web of stiffener material to the sheet stiffener feed conveyor;

providing a stiffener web cut-off mechanism disposed along the stiffener feed path configured for intermittently severing the stiffener web to form a plurality of stiffener web segments of a predetermined stiffener length, each stiffener web segment having a leading edge and a trailing edge, said stiffener length being less than said foil segment length; and sequentially transporting by the sheet stiffener feed conveyor the plurality of stiffener web segments to merge with the foil feed path at the angled intersect, such that one of the plurality of stiffener web segment enters the foil feed path in the gap between successive foil web segments and adjacently downstream of each feed end moving along the foil feed path.

26. The method of claim 25, wherein the feed end is displaced from the leading edge by at least the circumference of a first winding of the stiffener sheet.

27. The method of claim 25, further comprising the steps of:

providing an apertured foil conveyor extending along the foil feed path between the foil, cutting mechanism and the foil intersect, the foil conveyor moving at the feed rate;

providing a vacuum source selectively connectible to the apertured foil conveyor;

connecting the vacuum source to the aperture belt when the feed end is adjacent thereto to frictionally engage the foil web to the aperture belt; and biasing along the feed path the feed end of the foil toward the roll winder until the feed end is spirally wound into the foil roll.

28. The method of claim 27, wherein the roll winder has at least two winder drive rolls each having circumferential surfaces equidistantly displaced from the central axis and configured to rotate said foil roll by circumferential contact with the foil roll to spirally wind the foil web and said stiffener sheet.

29. The method of claim 28, wherein the roll discharge conveyor further comprises a first discharge friction surface and a spaced-apart second discharge friction surface configured to allow the foil roll to pass in circumferential contact therebetween when discharged by the roll winder, the first and second discharge surfaces relatively moveable to cause rotation of the foil roll.

30. The method of claim 29, wherein the foil web cutting mechanism comprises parallel cutter and anvil rolls positioned adjacent opposing surfaces of the foil web, the cutter and anvil rolls selectively relatively moveable into a first position to transversely sever the foil web, and a generally opposing second position allowing the foil web to pass between the cutter and anvil rolls unsevered.

31. The method of claim 29, wherein the feed rate may be varied among a plurality of pre-determined speeds.

32. The method of claim 27, further comprising the steps of:

providing a pair of movable winding cones located at either end of the roll winding recess, positioning the movable cones in a first position to engage the ends of the wound stiffener core to bias the core along the central axis; and positioning the movable cones in a second position in which the cones are disengaged from the wound stiffener core sufficiently to allow movement of the wound foil roll from the roll winder.

33. A foil roll with a wound stiffener core comprising:

a foil web having a feed end, said foil web provided to a roll winder along a first feed path by a first conveyor;

a flexible stiffener sheet having a leading edge, a trailing edge, and a stiffener length therebetween, and a stiffener width perpendicular thereto, said stiffener sheet provided to said roll winder along a second feed path by a second conveyor to merge with said first feed path at an angled intersect upstream of said roll winder, operation of said first and second conveyors being coordinated to position said leading edge at said angled intersect ahead of said feed end;

a core portion further comprising a first portion of said foil web and said stiffener sheet being directed in adjacent, coextensive contact downstream from said angled intersect into said roll winder by a plurality of moveable roll starter guide fingers defining, when in a first position, a generally cylindrical roll winding recess in said roll winder, and spirally wound about a central axis, said portion of said foil web positioned between said central axis and said stiffener sheet thereby preventing contact of said first portion of said foil web with said roll starter guide fingers while guide fingers are in said first position; and a roll portion further comprising a second portion of the foil web formed by spirally winding said second portion around said core portion by circumferential contact of said roll portion with at least two winding rollers in said roll winder, each winding roller having a circumferential surface equidistantly displaced from said central axis.

34. The foil roll of claim 33, wherein said foil web has a width less than said stiffener width.

35. The foil roll of claim 33, wherein said foil web has a width generally equal to said stiffener width.

36. The foil roll of claim 33, wherein said feed end is displaced from said leading edge by at least the circumference of a first winding of said stiffener sheet.

37. The foil roll of claim 33, wherein said feed end is displaced from said leading edge by less than the circumference of a first winding of said stiffener sheet.

38. The foil roll of claim 33, wherein said stiffener sheet is made from a stiff paper.

39. The foil roll of claim 38, wherein said stiff paper is a kraft paper.

* * * * *